US007878633B2

(12) United States Patent
Ogawa

(10) Patent No.: US 7,878,633 B2
(45) Date of Patent: Feb. 1, 2011

(54) INK REFILLING UNIT

(75) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 719 days.

(21) Appl. No.: 11/694,168

(22) Filed: Mar. 30, 2007

(65) Prior Publication Data

US 2007/0229627 A1 Oct. 4, 2007

(30) Foreign Application Priority Data

Mar. 31, 2006 (JP) ..... 2006-098204

(51) Int. Cl.
*B41J 2/175* (2006.01)

(52) U.S. Cl. ..... 347/85; 347/86

(58) Field of Classification Search ..... 347/49, 347/84, 85, 86, 87

See application file for complete search history.

(56) References Cited

U.S. PATENT DOCUMENTS 6,582,068 B2 * 6/2003 Ishizawa et al. ..... 347/85
7,252,374 B2 * 8/2007 Usui et al. ..... 347/84
7,255,431 B2 * 8/2007 Lui ..... 347/86
7,393,087 B2 * 7/2008 Iijima et al. ..... 347/84
7,441,872 B2 * 10/2008 Ito et al. ..... 347/49
2005/0195253 A1 9/2005 Iijima et al.

FOREIGN PATENT DOCUMENTS

JP 2005-246922 A 3/2007

* cited by examiner

*Primary Examiner*—Anh T. N. Vo
(74) *Attorney, Agent, or Firm*—Baker Botts L.L.P.

(57) ABSTRACT

The present invention surely absorbs ink leaked from an atmospheric pressure introducing port using an ink absorber while achieving the miniaturization of an ink jet recording apparatus. An ink absorber housing is constituted of a fixing plate and a frame body which is formed on a periphery of the fixing plate and accommodates an ink absorber therein. Projecting ridges which project toward the ink absorber side and are brought into contact with the ink absorber are formed on an inner surface of the frame body thus increasing a holding force for holding the ink absorber in the inside of the ink absorber housing. Since the projecting ridges are brought into contact with portions of the ink absorber and resiliently deform the ink absorber, the deformation occurs partially and a deformation quantity is small. Accordingly, it is possible to increase the holding force for holding the ink absorber while preventing the large crushing of the small pores and the small interstices among the fibers in the ink absorber. In this manner, even when a multi-functional device is further miniaturized, it is possible to allow the ink absorber to surely absorb ink leaked from an atmospheric pressure introducing port.

6 Claims, 26 Drawing Sheets

INK REFILLING UNIT

CROSS-REFERENCE TO RELATED APPLICATIONS

This application claims priority from Japanese Patent Application No. 2006-098204 filed on Mar. 31, 2006, the entire subject matter of which is incorporated herein by reference.

BACKGROUND OF THE INVENTION

1. Field of the Invention

Illustrative aspects of the present invention relate to an ink refilling unit of an ink jet recording apparatus (ink jet printer) having the structure which fixes an ink absorber provided for absorbing ink when the ink leaks from an atmospheric pressure introducing sleeve which brings an atmospheric pressure in the inside of an ink cartridge.

2. Description of the Related Art

The ink jet recording apparatus is, as being well known, configured to form an image on a recording medium such as a recording paper by injecting an ink liquid as liquid droplets toward the recording medium using a recording head.

Then, the refilling of ink is usually, instead of a method which refills an ink liquid in an ink tank fixed to an ink jet recording apparatus, performed by exchanging an ink cartridge which is filled with ink already (see patent document 1). [Patent document 1] JP-A-2005-246922

SUMMARY OF THE INVENTION

Here, the ink cartridge includes an atmospheric pressure introducing port. This atmospheric pressure introducing port is provided for introducing an atmospheric pressure into an ink tank portion in which ink is filled so as to facilitate the smooth supply of the ink filled in the ink cartridge to the recording head.

Accordingly, when a pressure inside the ink tank portion is increased due to the elevation of a temperature of the ink tank portion or the like, ink inside the ink tank portion may leak to the outside of the ink cartridge through the atmospheric pressure introducing port.

To overcome such a drawback, the inventor of the present invention has manufactured an ink refilling unit which arranges an ink absorber for absorbing ink leaked from an atmospheric pressure introducing port on a distal end side of an atmospheric pressure introducing sleeve which is communicated with the atmospheric pressure introducing port and has reviewed the performance of the ink filling unit. However, such a refilling unit gives rise to following new drawbacks.

That is, when cartridge casing in which ink cartridges are accommodated and an image recording part which includes a recording head are arranged close to each other to miniaturize the ink jet recording apparatus, a fixing plate which is provided for fixing the ink absorber to the cartridge casing and the image recording part interfere with each other.

This drawback may be overcome by displacing the fixing plate to a position at which the interference between the fixing plate and the image recording part no more occurs. However, such a constitution displaces a contact portion between the atmospheric pressure introducing sleeve and the ink absorber to an end-portion side of the ink absorber. Accordingly, the relative position of the ink absorber with respect to the fixing plate is displaced and hence, the atmospheric pressure introducing sleeve and the ink absorber cannot be brought into contact with each other whereby the possibility that the ink absorber cannot absorb the leaked ink is increased.

On the other hand, the ink absorber is made of a porous material such as sponge, urethane, fibers, non-woven fabric or the like and, at the same time, is mounted on the fixing plate and is fitted into a frame body formed on a periphery of the fixing plate in a state that an outer peripheral portion of the ink absorber is slightly depressed by the frame body.

Accordingly, when a deformation quantity of the ink absorber in a state that the ink absorber is fitted into the frame body is small, a holding force for holding the ink absorber to the fixing plate becomes small.

However, the ink absorber absorbs and holds the ink by innumerable number of small pores or interstices among fibers formed in the inside of the ink absorber. Accordingly, when the ink absorber is fitted into the frame body in a state that the ink absorber is largely deformed for ensuring the large holding force, the small pores or interstices among fibers for absorbing the ink are crushed or collapsed and hence, the ink absorber cannot absorb a sufficient quantity of ink.

That is, when the holding force is increased to prevent the displacement of the ink absorber to surely bring the ink absorber and the atmospheric pressure introducing sleeve into contact with each other, the small pores or small interstices among fibers are crushed or collapsed and hence, the ink absorber cannot absorb a sufficient quantity of ink.

On the other hand, when the holding force is decreased so as to prevent the crushing or the collapse of the small pores or interstices among fibers for absorbing the ink, the position of the ink absorber is displaced and hence, it is impossible to surely bring the ink absorber and the atmospheric pressure introducing sleeve into contact with each other whereby the ink absorber cannot absorb a sufficient quantity of ink.

Aspects of the present invention provide an ink refilling unit which can surely absorb ink leaked from an atmospheric pressure introducing sleeve using the ink absorber even when an ink jet recording apparatus is miniaturized.

To achieve the above-mentioned object, according to a first aspect of the present invention, there is provided an ink refilling unit which comprises: an ink cartridge configured to store ink, the ink cartridge including a discharge port configured to discharge the ink, and an atmospheric-pressure introducing port configured to introduce atmospheric pressure to an inside of the ink cartridge, a cartridge casing configured to receive the ink cartridge therein, the cartridge casing including an atmospheric-pressure introducing sleeve having a distal end projecting to outside, the atmospheric-pressure introducing sleeve communicating with the atmospheric-pressure introducing port of the ink cartridge, an ink absorber disposed in contact with the distal end of the atmospheric-pressure introducing sleeve, the ink absorber configured to absorb ink leaked from the atmospheric-pressure introducing port, and an ink absorber housing including a fixing plate and a frame body formed on a periphery of the fixing plate, the ink absorber housing configured to accommodate the ink absorber therein and fix the ink absorber to the fixing plate, the ink absorber housing including at least one projecting ridge on an inner surface of the frame body, the projecting ridge configured to press the ink absorber accommodated in the ink absorber housing.

Due to such a constitution, the present invention can deform the ink absorber with the projecting ridges which project toward the ink absorber side and hence, it is possible to increase a holding force for holding the ink absorber on the fixing plate (frame body).

On the other hand, the projecting ridges are brought into contact with portions of the ink absorber thus partially deforms the ink absorber and hence, compared to a case in which a whole outer peripheral surface of the ink absorber is depressed, the deformation of the ink absorber is performed partially thus lowering a deformation quantity of the ink absorber.

According to the present invention, it is possible to increase the holding force for holding the ink absorber while preventing the large crushing of the small pores or the small interstices among the fibers in the ink absorber. In this manner, even when an inkjet recording apparatus is further miniaturized, it is possible to allow the ink absorber to surely absorb ink leaked from an atmospheric pressure introducing port.

According to the first aspect of the present invention, the projecting ridge may be arranged in a position remote from the distal end of the atmospheric-pressure introducing sleeve in a direction perpendicular to a direction in which the atmospheric-pressure introducing sleeve projects.

Due to such a constitution, the displacement of the portions of the ink absorber which are brought into contact with the atmospheric pressure introducing sleeves can be surely prevented and hence, the ink leaked from the atmospheric pressure introducing port can be surely absorbed by the ink absorber.

According to the first aspect of the present invention, the projecting ridge may be arranged in a position substantially vertically below a position where the distal end of the atmospheric-pressure introducing sleeve contacts the ink absorber accommodated in the ink absorber casing.

Further, according to the first aspect of the present invention, the ink absorber housing may have portions thereof fixed to the cartridge casing at positions which sandwich a center position of the atmospheric-pressure introducing sleeve in a direction perpendicular to a projecting direction of the atmospheric-pressure introducing sleeve.

Here, for example, when all fixing portions between the fixing plate and the cartridge casing are arranged at one side with respect to the center position of the atmospheric pressure introducing sleeve, a fixing force is not generated on another side. Accordingly, due to a reaction force for bringing the ink absorber into contact with the atmospheric pressure introducing sleeve, the fixing plate is largely deformed or inclined and hence, it is impossible to surely bring the ink absorber into contact with the atmospheric pressure introducing sleeve.

To the contrary, according to the first aspect of the present invention, the fixing plate is fixed to the cartridge casing at both positions with respect to the atmospheric pressure introducing sleeve in the direction that the fixing plate faces the distal end of the atmospheric pressure introducing sleeve. Accordingly, it is possible to prevent the phenomenon that the fixing plate is largely deformed or inclined due to a reaction force for bringing the ink absorber into contact with the atmospheric pressure introducing sleeve thus surely bringing the ink absorber into contact with the atmospheric pressure introducing sleeve.

According to a second aspect of the present invention, there is provided a leaked ink absorbing method for an ink jet recording apparatus which comprises the steps of: mounting a plurality of ink cartridges each configured to store ink and include an atmospheric pressure introducing port in the inside of a cartridge casing, connecting the respective atmospheric pressure introducing ports of the plurality of ink cartridges communicably with a plurality of atmospheric pressure introducing sleeves which are formed on the cartridge casing and have distal ends thereof projected to the outside of the cartridge casing, connecting an ink absorber housing which is constituted of a fixing plate and a frame body formed on a periphery of the fixing plate and accommodates an ink absorber to the cartridge casing, bringing the ink absorber into contact with the distal ends of the atmospheric pressure introducing sleeves thus allowing the ink absorber to absorb ink leaked from the atmospheric pressure introducing port, and fixing the ink absorber firmly to the ink absorber casing by deforming the ink absorber with compression generated using projecting ridges which are formed on an inner surface of the frame body vertically below the atmospheric pressure introducing sleeves thus firmly fixing the ink absorber to the ink absorber casing and promoting the ink leaked from the atmospheric pressure introducing ports.

Due to such a constitution, with the provision of the projecting ridges, it is possible to increase a holding force for holding the ink absorber on the fixing plate (frame body). At the same time, with the provision of the projecting ridges, the deformation of the ink absorber is performed partially thus lowering a deformation quantity of the ink absorber. Accordingly, it is possible to increase the holding force for holding the ink absorber while preventing the large crushing of the small pores and the small interstices defined between the fibers in the ink absorber. In this manner, even when an ink jet recording apparatus is further miniaturized, it is possible to allow the ink absorber to surely absorb ink leaked from an atmospheric pressure introducing port.

BRIEF DESCRIPTION OF DRAWINGS

Illustrative aspects of the invention will be described in detail with reference to the following figures in which like elements are labeled with like numbers and in which.

DETAILED DESCRIPTION OF THE INVENTION

Hereinafter, an embodiment to which the present invention is applied is described in conjunction with drawings. Here, the embodiment of the present invention is not limited to the embodiment described later and various modifications are considered without departing from a technical scope of the present invention.

In the embodiment, an ink jet recording apparatus according to the present invention is applied to a so-called multi-functional device having a printer function, a scanner function, a copier function, a facsimile function and the like.

An embodiment of the invention will be described. Here, the multi-functional device according to the embodiment is connected to a computer so as to record an image containing characters to a recording medium such as a recording sheet or an OHP sheet (hereinafter referred to as a recording sheet) based on image data or document data transmitted from the computer. The multi-functional device is connected to an external apparatus such as a digital camera so as to record image data outputted from the digital camera to the recording sheet.

1. Schematic Constitution of Multi-Functional Device 1

Figure 1:
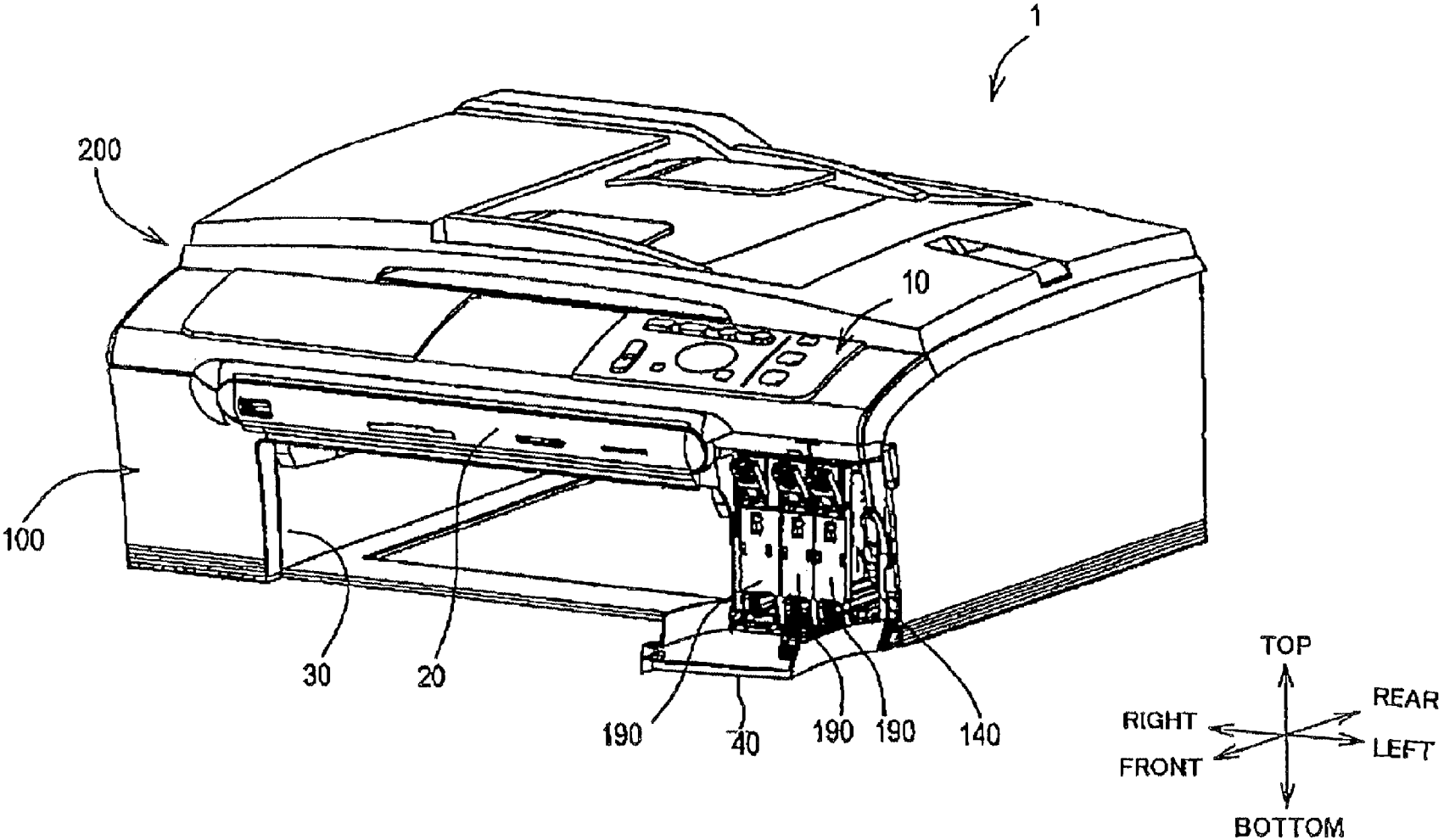
FIG. 1 is a perspective view showing the appearance of a multi-functional device according to an embodiment of the present invention.
Figure 2:
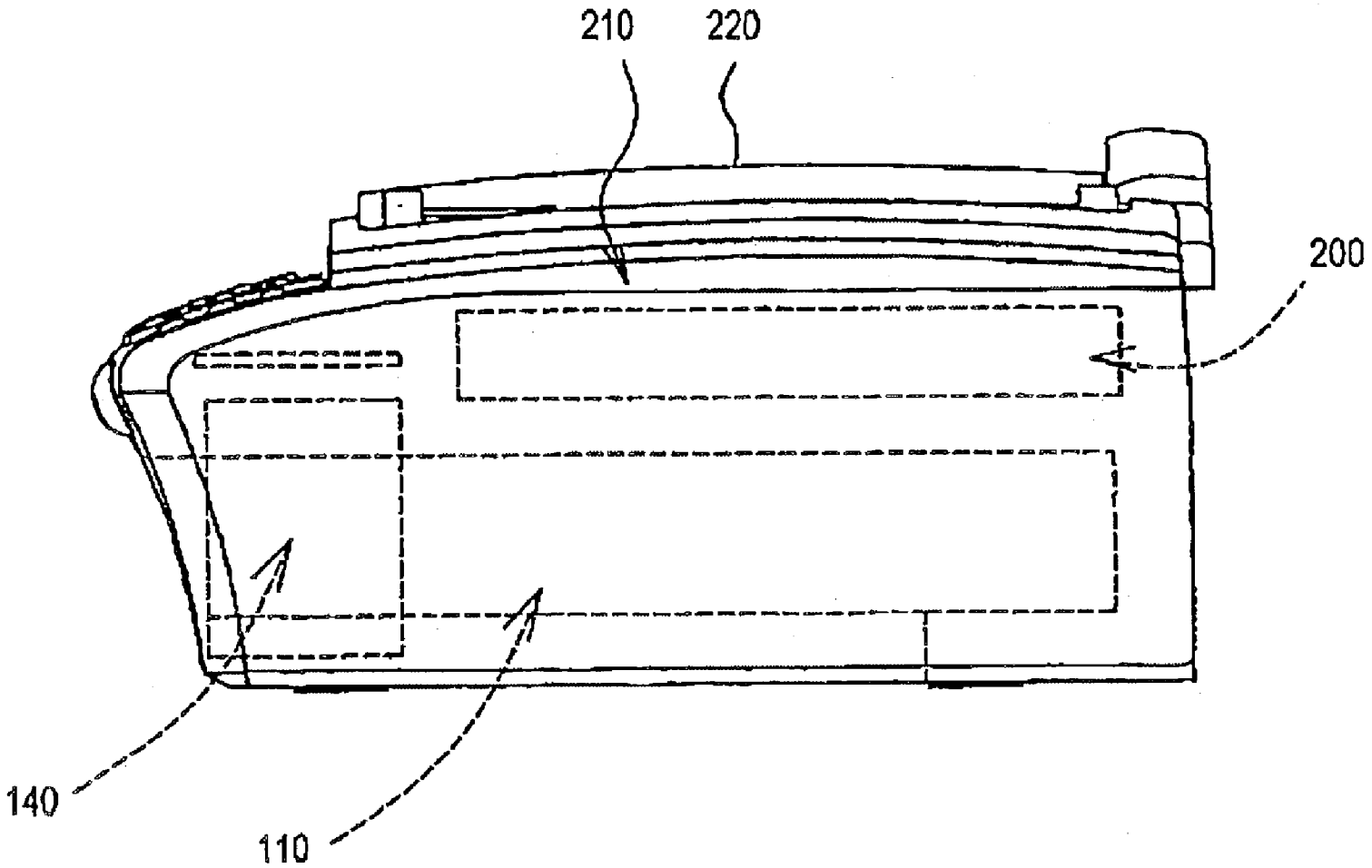
FIG. 2 is a cross-sectional view of the multi-functional device according to the embodiment of the present invention.

FIG. 1 is a perspective view showing the appearance of a multi-functional device 1, and FIG. 2 is a side view of the multi-functional device 1. Here, a portion indicated by a broken line in FIG. 2 indicates devices housed in the inside of the multi-functional device 1.

As shown in FIG. 1, a printer part 100 which forms an image on a recording sheet is disposed in a lower portion of the multi-functional device 1, while a scanner part 200 which reads an image on an original is disposed in an upper portion of the multi-functional device 1.

Here, the scanner part 200 of the multi-functional device 1 according to this embodiment includes, as shown in FIG. 2, a flatbed scanner (FBS) which reads an original placed on an original placing part 210, and an automatic document feeder (ADF) 220.

Further, on an inclined surface of an upper portion of a front side of the multi-functional device 1, as shown in FIG. 1, an operation panel 10 for setting the printer part 100 and the scanner part 200 by manual operation is provided. A slot part 20 which allows an insertion of a storage medium such as a memory card therein, and an insertion port 30 which allows an insertion of a paper feeding tray 121 described later therein are located on a front side of the manipulation panel 10.

2. Printer Part

Figure 3:
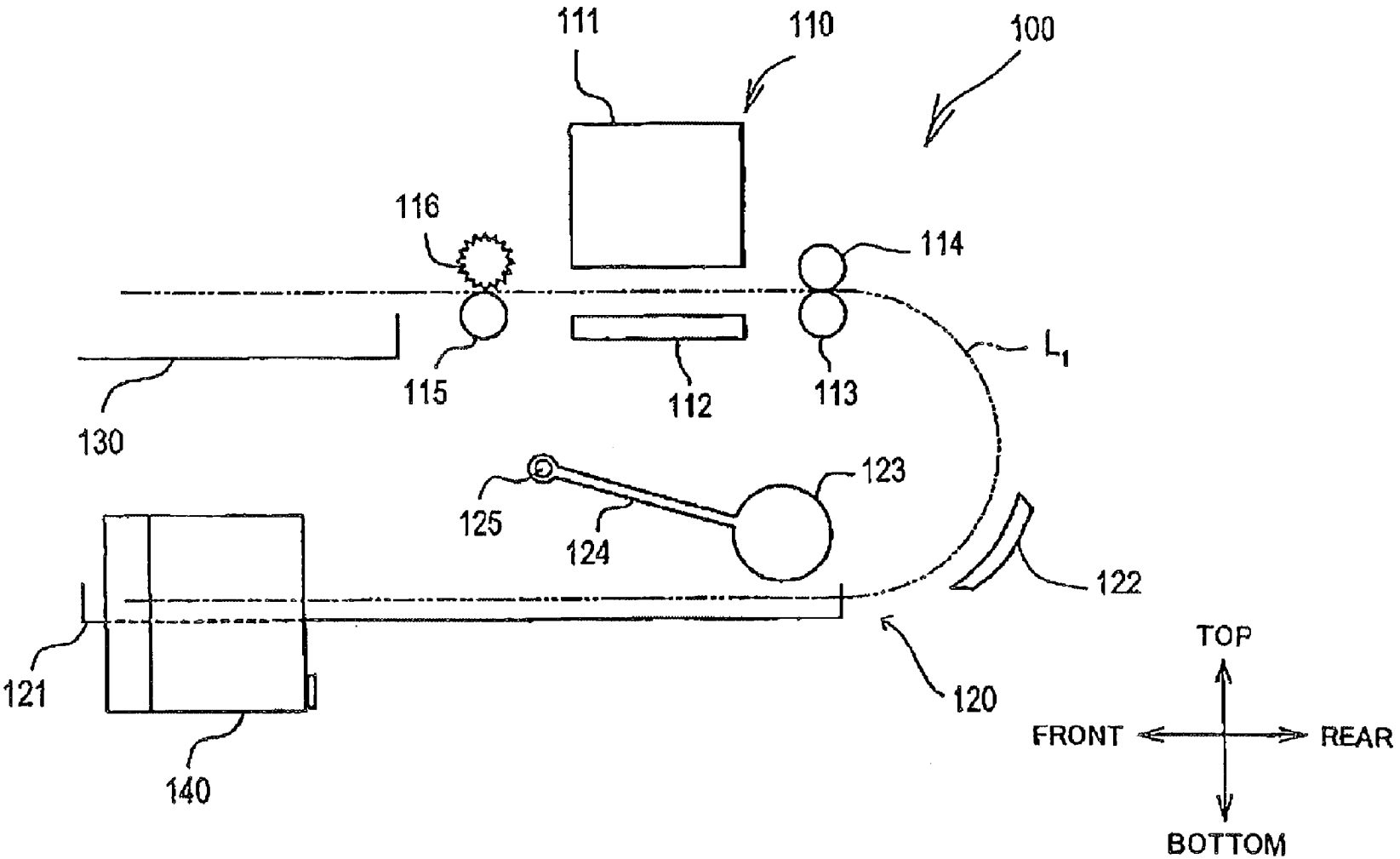
FIG. 3 is a schematic view of a printer part (a part indicated by a broken line in FIG. 2) according to the embodiment of the present invention.

FIG. 3 is a schematic view of the printer part 100 (part indicated by a broken line in FIG. 2). The printer part 100 includes an image recording part 110 which forms an image on a recording sheet, a feeder part 120 which feeds a recording sheet to the image recording part 110, an ink refilling unit 140 which supplies ink to the image recording part 110 and the like.

2.1 Feeder Part (see FIG. 3)

The paper feeding tray 121 on which a large number of recording sheets are placed is arranged at a bottom portion of the multi-functional device 1 (printer part 100), while an inclined separation plate 122 which separates one recording sheet from the remaining recording sheets placed on the paper feeding tray 121 and guides the separated recording sheet upwardly is arranged at a rear side of the paper feeding tray 121 (the right side in FIG. 3).

Further, the inclined separation plate 122 extends upwardly to form a conveyance path L1 for the recording sheet. The conveyance path L1 is curved toward a front side after extending upwardly, extends toward a front side from a rear side of the multi-functional device 1, and communicates with a paper discharge tray 130 after passing the image recording part 110.

Accordingly, the recording sheet which is fed from the paper feeding tray 121 is guided to make a U-turn upward and reaches the image recording part 110 where the image is formed on the recording sheet, and the recording sheet is discharged to a sheet discharge tray 130.

Further, a paper feeding roller 123 is configured to feed the recording sheets stacked on the paper feeding tray 121 to a conveyance path L1 one by one in a separate manner. The paper feeding roller 123 may be of any well-known structure.

That is, for example, the paper feeding roller 123 is pivotally supported on a distal end of a paper feeding arm 124 and is connected to a motor by way of a drive transmission mechanism. The paper feeding arm 124 has a proximal end thereof pivotally connected to a proximal-end shaft 125 to allow the paper feeding roller 123 to move in the vertical direction and to be in contact with or to be separated from the recording sheet on the paper feeding tray 121. The paper feeding roller 123 is moved upwardly to be away from the recording sheet in a standby state, and is moved downwardly to be in contact with the recording sheet at the time of feeding the recording sheet using a paper feed clutch, a spring or the like not shown in the drawing.

2.2 Image Recording Part 110 (see FIG. 3]

The image recording part 110 constitutes an image forming unit which forms an image on the recording sheet. To be more specific, the image recording part 110 includes a recording head 111 which ejects fine ink droplets to the recording sheet conveyed to the platen 112. The recording head 111 is mounted on a carriage (not shown in the drawing) which reciprocally moves the recording head 111 in the main scanning direction (the direction perpendicular to the paper surface of FIG. 3). Here, the image recording part 110 (carriage) is supported on rail members 117 (see FIG. 4) which extend in the lateral direction of the multi-functional device 1 such that the image recording part 110 (carriage) is movable in the main scanning direction.

Further, on an upstream side of the recording head 111 (platen 112) in the paper conveying direction, a drive roller 113 and a pressing roller 114 are arranged. These drive roller 113 and pressing roller 114 sandwich the recording sheet which is conveyed along the conveyance path L1 and conveys the recording sheet to the platen 112 in an interlocking manner with the reciprocation of the carriage.

The drive roller 113 is rotated with a drive force imparted from an electric motor not shown in the drawing, while the pressing roller 114 is rotated as a follower by pressing the recording sheet to the pressing roller 113 side.

Further, on a downstream side of the recording head 111 (platen 112) in the paper conveying direction, a paper discharge roller 115 and a pressing roller 116 are arranged. The paper discharge roller 115 and the pressing roller 116 sandwich the recording sheet which is discharged from the image recording part 110 and convey the recording sheet on which printing is completed to the paper discharge tray 130.

The paper discharge roller 115 is rotated in a mechanically interlocking manner (synchronously) with the rotation of the drive roller 113, while the pressing roller 116 is rotated as a follower by pressing the recording sheet to the paper discharge roller 115 side.

The pressing roller 116 is brought into pressure contact with the recording-finished recording sheet. To prevent the image recorded on the recording sheet from being deteriorated due to such a pressure contact, a contact surface of the pressing roller 116 which is in contact with the recording sheet has an irregular gear-teeth-like surface.

2.3. Ink Refilling Unit 2.3.1. Structure of Ink Refilling Unit

In the inside of the ink refilling unit 140, four flat ink cartridges 190 (see FIG. 1) in which four kinds of inks of black, yellow, magenta and cyan are respectively filled are replaceably held in parallel to each other. The inks which are filled in the ink cartridges 190 are supplied to the recording heads 111 by way of ink tubes 141 (see FIG. 4) which are formed of a material having flexibility such as polyethylene.

Figure 4:
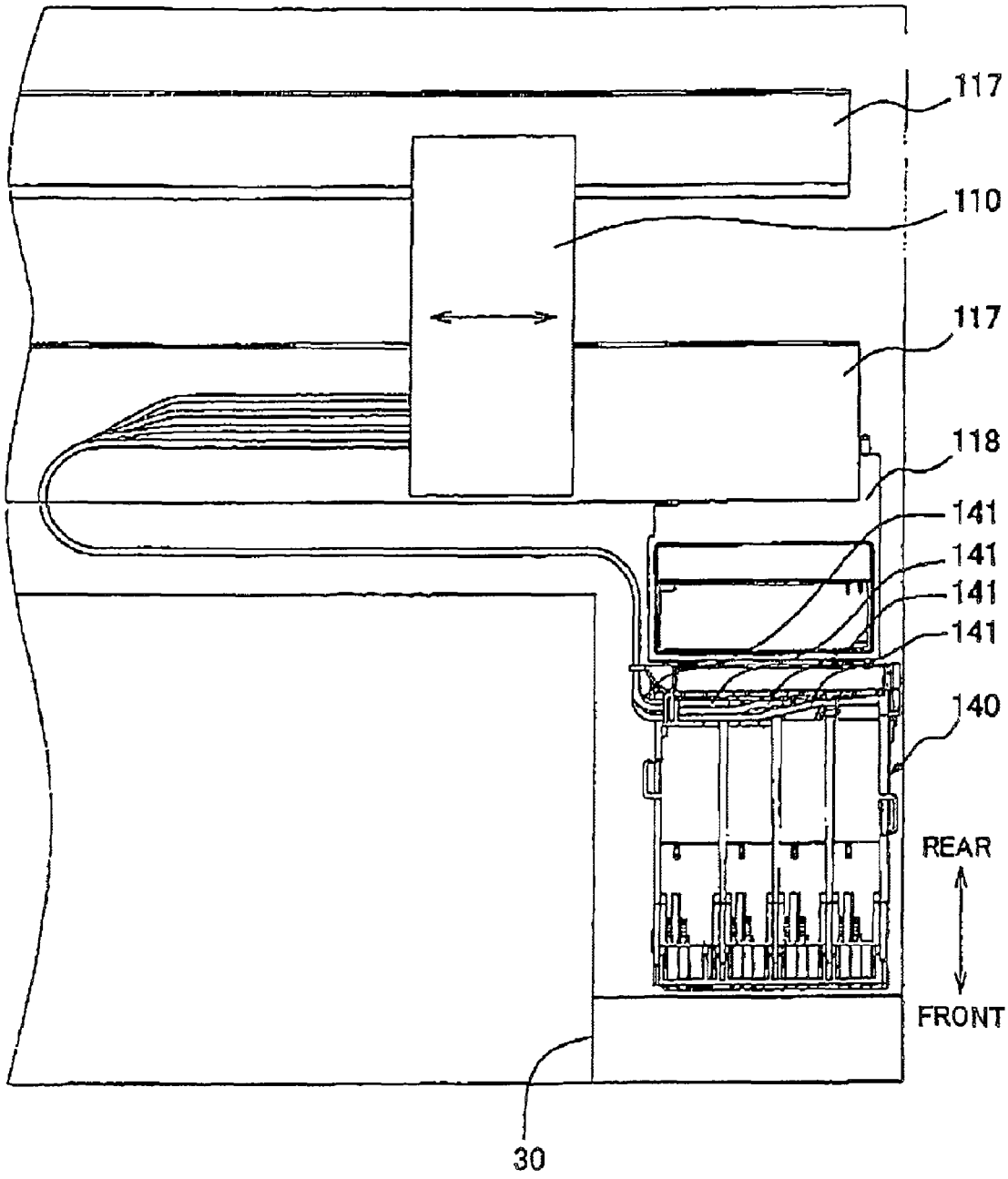
FIG. 4 is a view showing the arrangement relationship between an ink refilling unit and an image recording part or the like as viewed from an upper surface side.

Further, the ink refilling unit 140 is arranged, as shown in FIG. 1 and FIG. 4, at a right end portion on a front surface side of the multi-functional device 1. Further, the ink refilling unit 140 is incorporated in the multi-functional device 1 such that a liquid level of the ink when the ink is filled in the ink cartridge 190 becomes lower than an ink ejection port formed in the recording head 111 (not shown in the drawing), as shown in FIG. 3.

As shown in FIG. 4, a waste ink box 118 which stores the waste ink ejected at the time of performing purge operation for removing foreign materials in the inside of the recording head 111 is arranged close to a back side of the ink refilling unit 140. Due to such an arrangement, it is almost possible to eliminate the occurrence of a dead space on the back side of the ink refilling unit 140.

Here, as shown in FIG. 1, an open/close cover 40 which covers a front side of the ink refilling unit 140 is mounted on a front side of the multi-functional device 1. In mounting (or loading) the ink cartridges 190 in the ink refilling unit 140 or in removing the ink cartridges 190 from the ink refilling unit 140, a user can detachably replace the ink cartridges 190 from the ink refilling unit 140 by opening the cover 40.

2.3.2 Ink Cartridge

Figure 8:
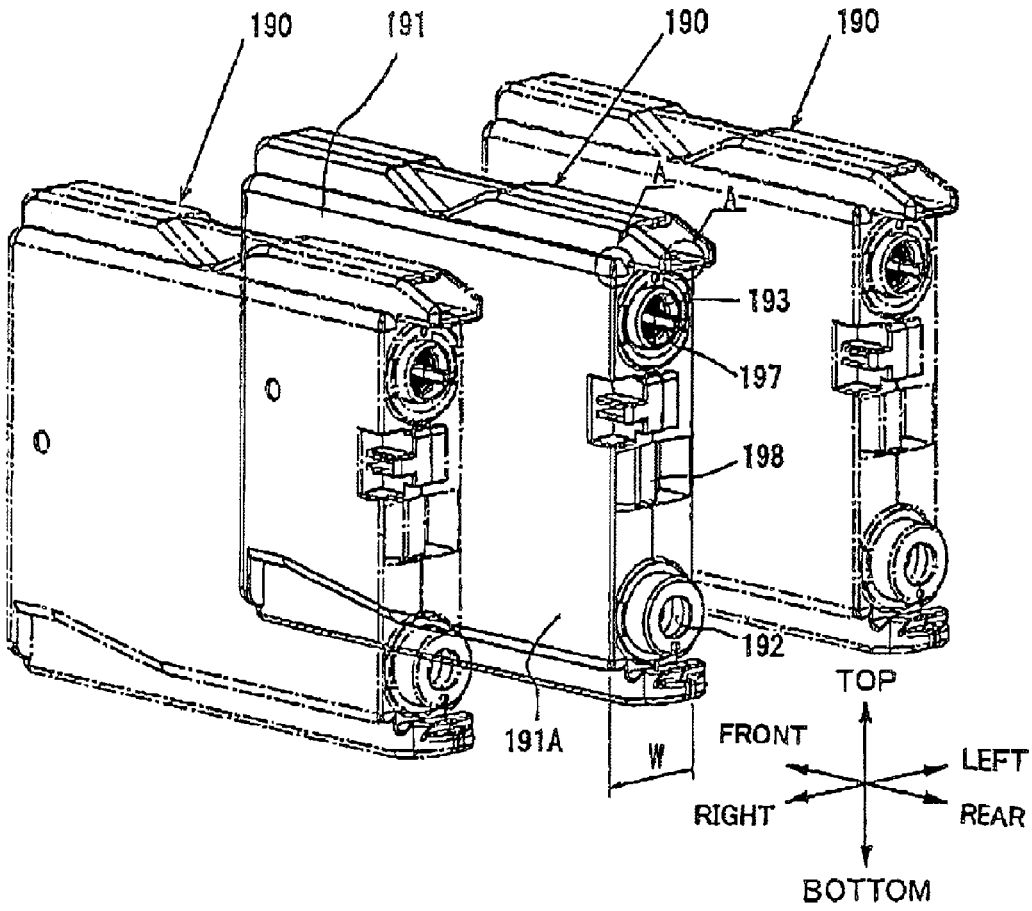
FIG. 8 is a perspective view of ink cartridges according to the embodiment of the present invention.

Each ink cartridge 190 is, as shown in FIG. 8, formed in a flat shape and includes a flat rectangular parallelepiped ink tank portion 191 having a size W in the widthwise direction (in the lateral direction in FIG. 8) smaller than a size in other direction. In a rear end surface of the ink tank portion 191, a discharge port 192 which opens in the direction orthogonal to the rear end surface (in the longitudinal direction in FIG. 8) is formed so as to discharge the ink filled in the ink tank portion 191. Further, in the same rear end surface of the ink tank portion 191, an atmospheric-pressure introducing port 193 which opens in the same direction as the discharge port 192 is formed so as to introduce an atmospheric pressure into the inside of the ink tank portion 191.

Here, the discharge port 192 is arranged at a lowermost portion of the ink tank portion 191 such that all ink filled in the ink tank portion 191 can be discharged. The atmospheric-pressure introducing port 193 is arranged at an uppermost portion of the ink tank portion 191 such that the inside and the outside of the ink tank portion 191 communicate with each other above a liquid level of the ink filled in the ink tank portion 191.

An open/close valve is made of a resilient material which is resiliently deformable such as rubber (not shown in the drawing). The open/close valve is arranged in the inside of the discharge port 192. When the ink cartridge 190 is loaded into the cartridge casing 142, a cartridge-side needle 172 of an elbow member 170 described later (see FIG. 19) pushes the open/close valve thus opening the discharge port 192.

To the contrary, when the ink cartridge 190 is removed from the cartridge casing 142, a pushing force generated by the cartridge-side needle 172 is removed and hence, the open/close valve is closed thus closing the discharge port 192.

Figure 7:
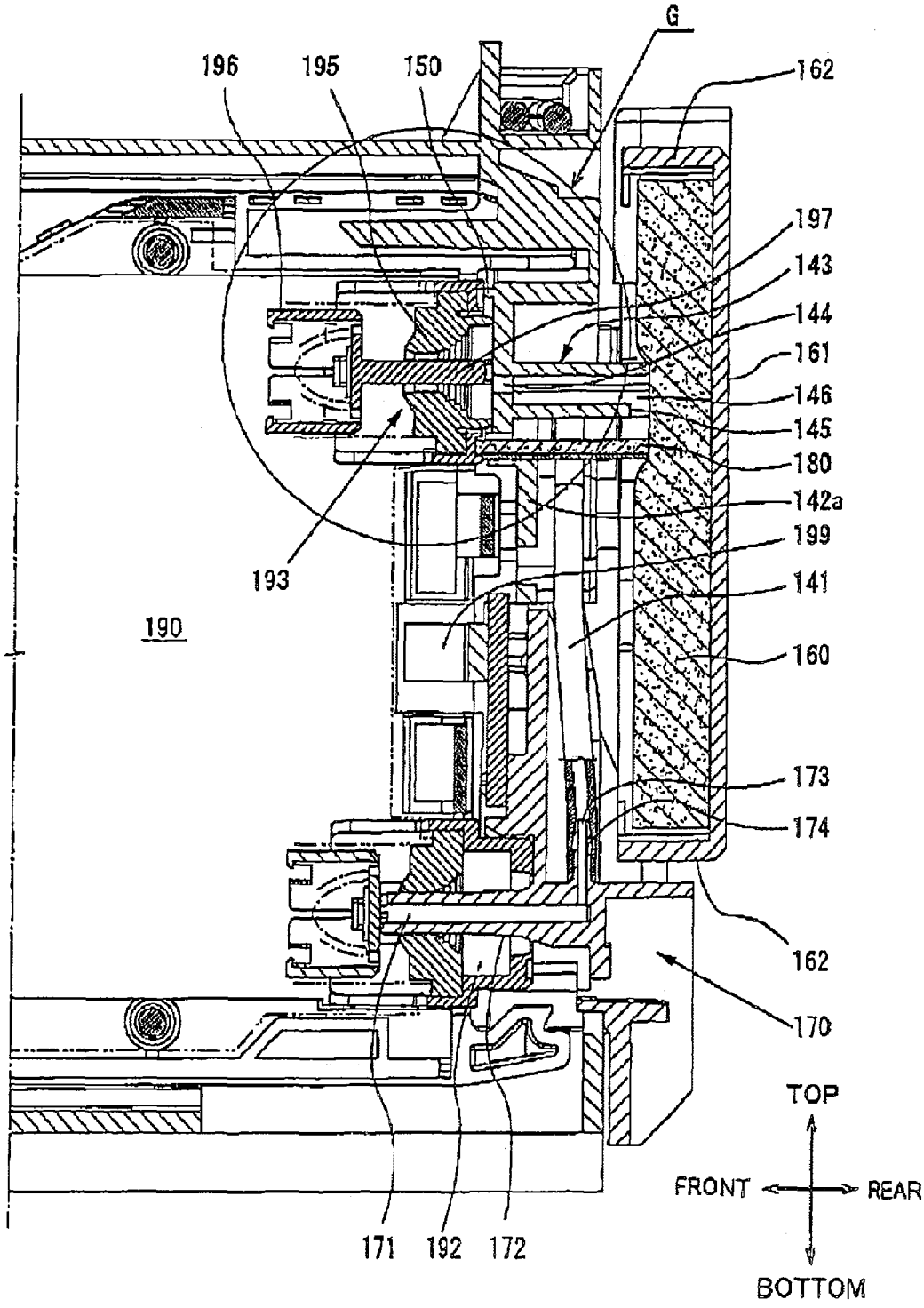
FIG. 7 is a cross-sectional view taken along a line B-B of FIG. 6.

Further, in the inside of the atmospheric-pressure introducing port 193, as shown in FIG. 7, a valve seat 195 made of a resilient material which is resiliently deformable such as rubber and a valve element 196 which closes the atmospheric-pressure introducing port 193 by coming into contact with the valve seat 195 from the inside of the ink tank portion 191 are arranged. The valve element 196 includes a valve rod 197 which penetrates the valve seat 195 and extends to the outside of the ink tank portion 191.

Due to such a structure, when the ink cartridge 190 is loaded into the cartridge casing 142 described later, a distal end of the valve rod 197 comes into contact with an inner wall of the cartridge casing 142, and the valve element 196 is pushed to the inside of the ink tank portion 191 and hence, the atmospheric-pressure introducing port 193 (valve seat 195) opens.

On the other hand, when the ink cartridge 190 is removed from the cartridge casing 142, the pushing force applied to the valve rod 197 is eliminated and hence, the valve element 196 is pushed to the valve seat 195 due to a resilient force of a return rubber not shown in the drawing whereby the atmospheric-pressure introducing port 193 is closed.

Further, as shown in FIG. 8, an ink window 198 is provided between the discharge port 192 and the atmospheric-pressure introducing port 193. The ink window 198 is used for detecting a residual quantity of ink in the inside of the ink tank portion 191 (ink cartridge 190). An ink residual quantity detection sensor 199, which is arranged on the cartridge casing 142 side (see FIG. 7), is configured to optically detect the ink residual quantity through the ink window 198. To be more specific, the ink residual quantity is detected in the following manner.

That is, in this embodiment, the ink residual quantity detection sensor 199 is constituted of a light emitting element and a light receiving element which are arranged at positions in the cartridge casing 142 where these elements sandwich the ink window 198 there between. That is, the light emitting element is arranged on one horizontal side of the ink window 198 and the light receiving element is arranged on another horizontal side of the ink window 198. The ink window 198 is configured to extend in the vertical direction and, at the same time, to allow the light to pass there through in the horizontal direction.

Further, a detection element (actuator; not shown in the drawing), which vertically moves corresponding to an ink residual quantity, is arranged in the inside of the ink cartridge 190. The detection element is positioned in the inside of the ink window 196 when the ink residual quantity is large and retracts from the ink window 198 when the ink residual quantity becomes small.

Accordingly, when the ink residual quantity is large, light emitted from the light emitting element is interrupted by the detection element which is positioned in the ink window 198 and hence, the light receiving element cannot receive the light. When the ink residual quantity becomes small, the detection element retracts from the ink window 198 and hence, the light emitted from the light emitting element is no more interrupted by the detection element whereby the light emitted from the light emitting element passes through the ink window 198 and is received by the light receiving element. In this embodiment, the ink residual quantity is detected based on a signal outputted form the light receiving element.

2.3.3 Cartridge Casing

As shown in FIG. 5, FIG. 9A, FIG. 9B and FIG. 10, the cartridge casing 142 is a box-shaped housing. Four flattened ink cartridges 190 each of which opens the discharge port 192 and the atmospheric-pressure introducing port 193 in the substantially horizontal direction in a rear side thereof are replaceably loaded in the cartridge casing 142. That is, four ink cartridges 190 are replaceably mounted in the inside of the cartridge casing 142 in a state that flat surfaces 191A of the neighboring ink cartridges 190 face each other as shown in FIG. 8.

Figure 12:
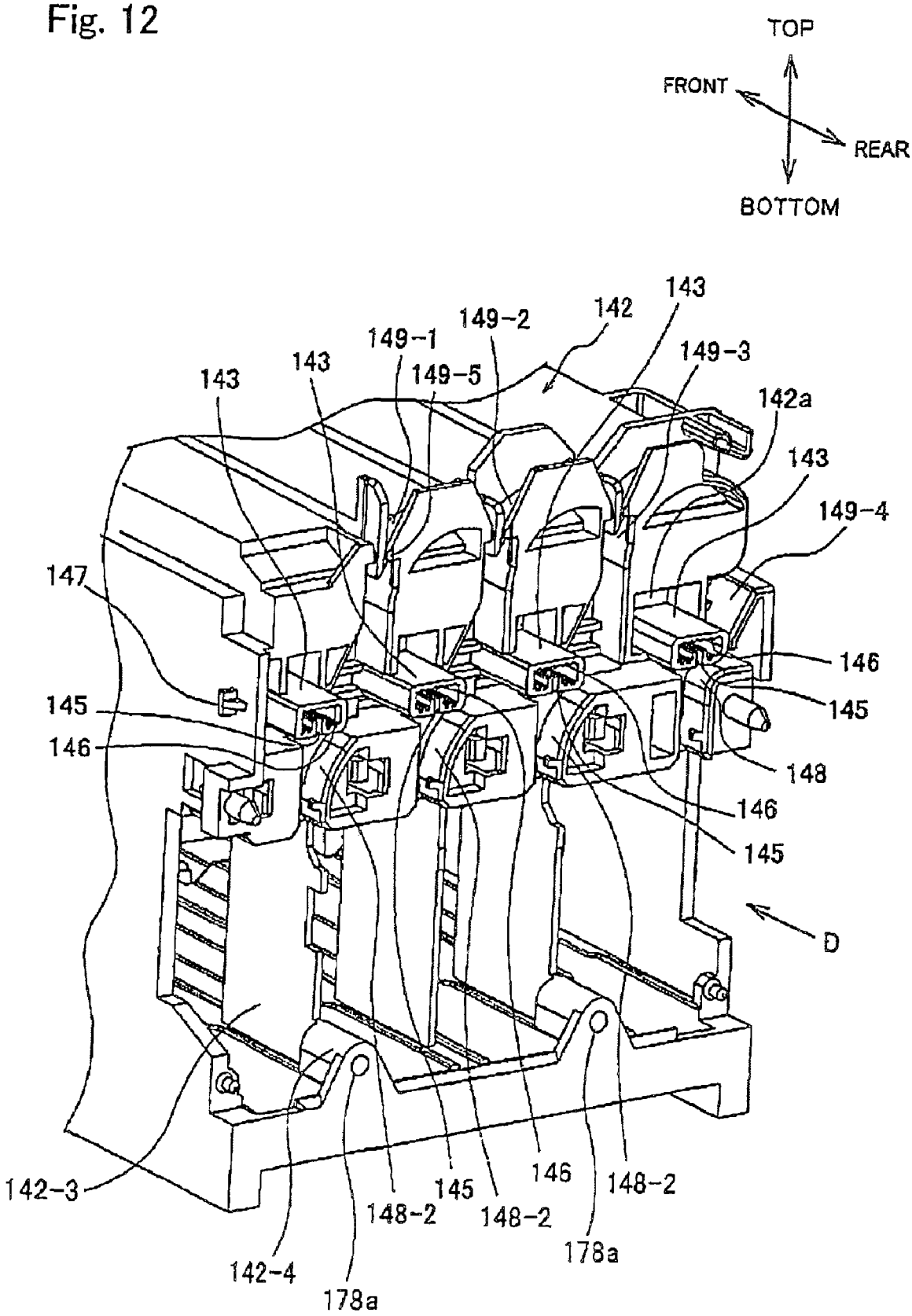
FIG. 12 is a perspective view of a cartridge casing according to the embodiment of the present invention.

Further, on one side (front side in this embodiment) of the cartridge casing 142 in the horizontal direction, an insertion hole for inserting the ink cartridges 190 in the inside of the cartridge casing 142 is formed (not shown in the drawing). On another side (rear side in this embodiment) of the cartridge casing 142 in the horizontal direction, as shown in FIG. 12, atmospheric-pressure introducing sleeves 143, which communicate with the atmospheric-pressure introducing ports 193 when the ink cartridges 190 are loaded in the cartridge casing 142, are formed. The atmospheric-pressure introducing sleeves 143 project to the outside from the cartridge casing 142.

Figure 13:
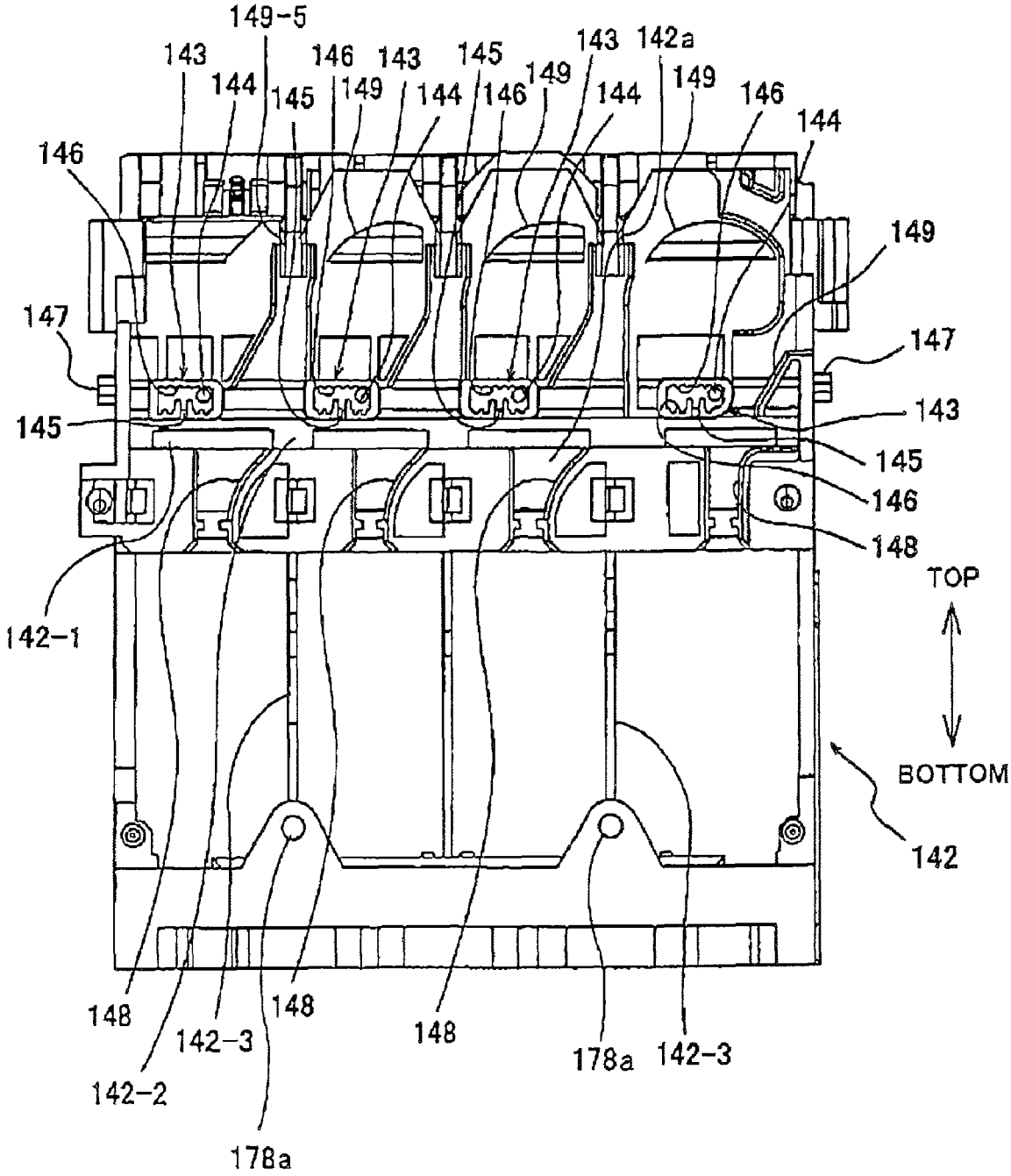
FIG. 13 is a view as viewed in the direction of an arrow D in FIG. 12 (a back view of the cartridge casing)

Further, as shown in FIG. 12 and FIG. 13, a lower half portion of the rear side of the cartridge casing 142 opens to form an open space. In the inside of the open space, vertical partition plates 142-3 and elbow member mounting projecting portions 142-4 are integrally formed. The vertical partition plates 142-3 define four spaces for accommodating four ink cartridges 190 respectively. The elbow member mounting projecting portions 142-4 project from lower ends of the vertical partition plates 142-3. A female threaded hole 178*a* is formed in each elbow member mounting projecting portion 142-4. As described in detail later in conjunction with FIG. 9AA, FIG. 10 and FIG. 15 to FIG. 19, an elbow member 170 is mounted on the elbow member mounting projecting portions 142-4 using bolts 178.

Figure 9A:
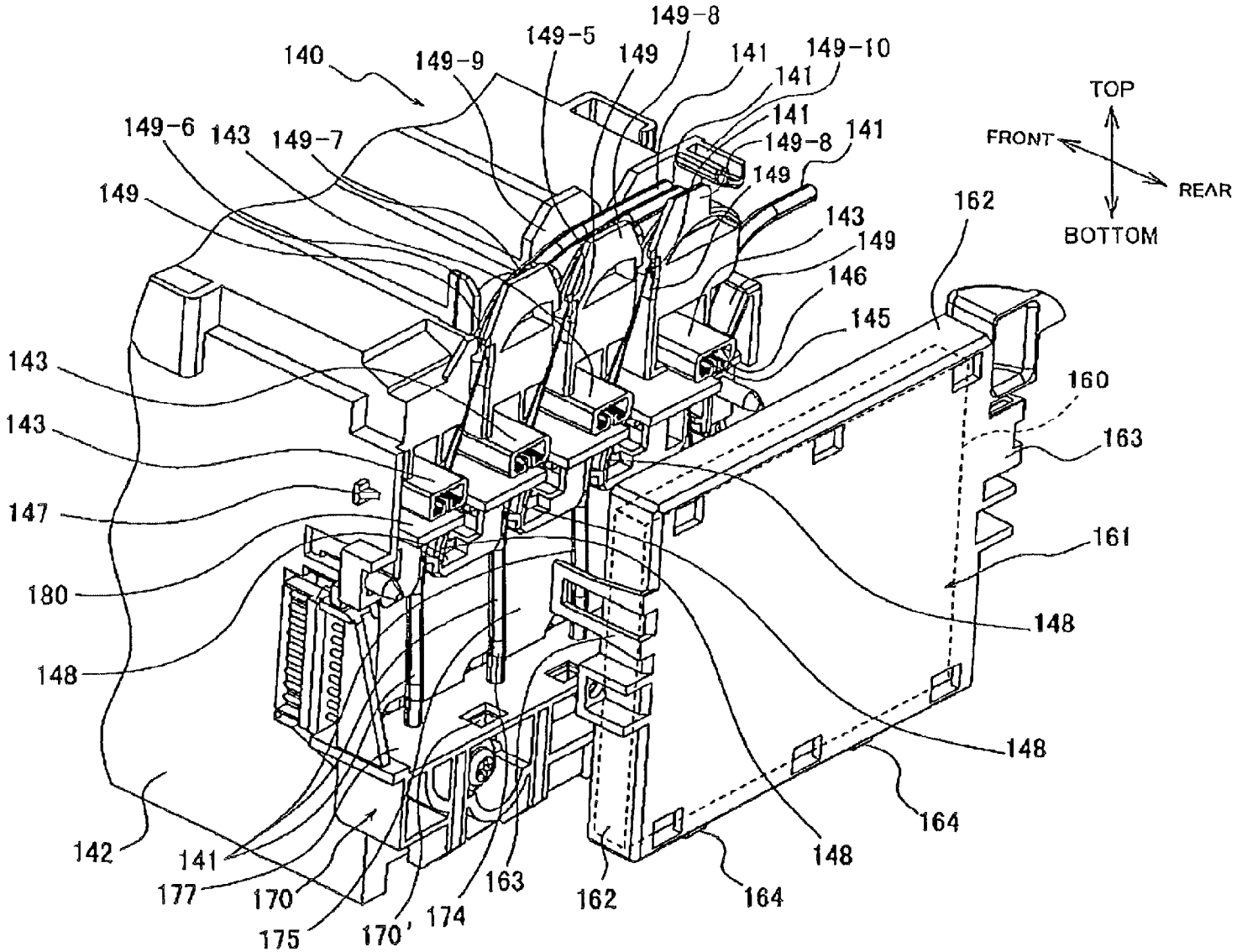
FIG. 9A is an exploded perspective view showing a state in which an ink absorber casing is removed from the ink refilling unit in the embodiment of the present invention.
Figure 9B:
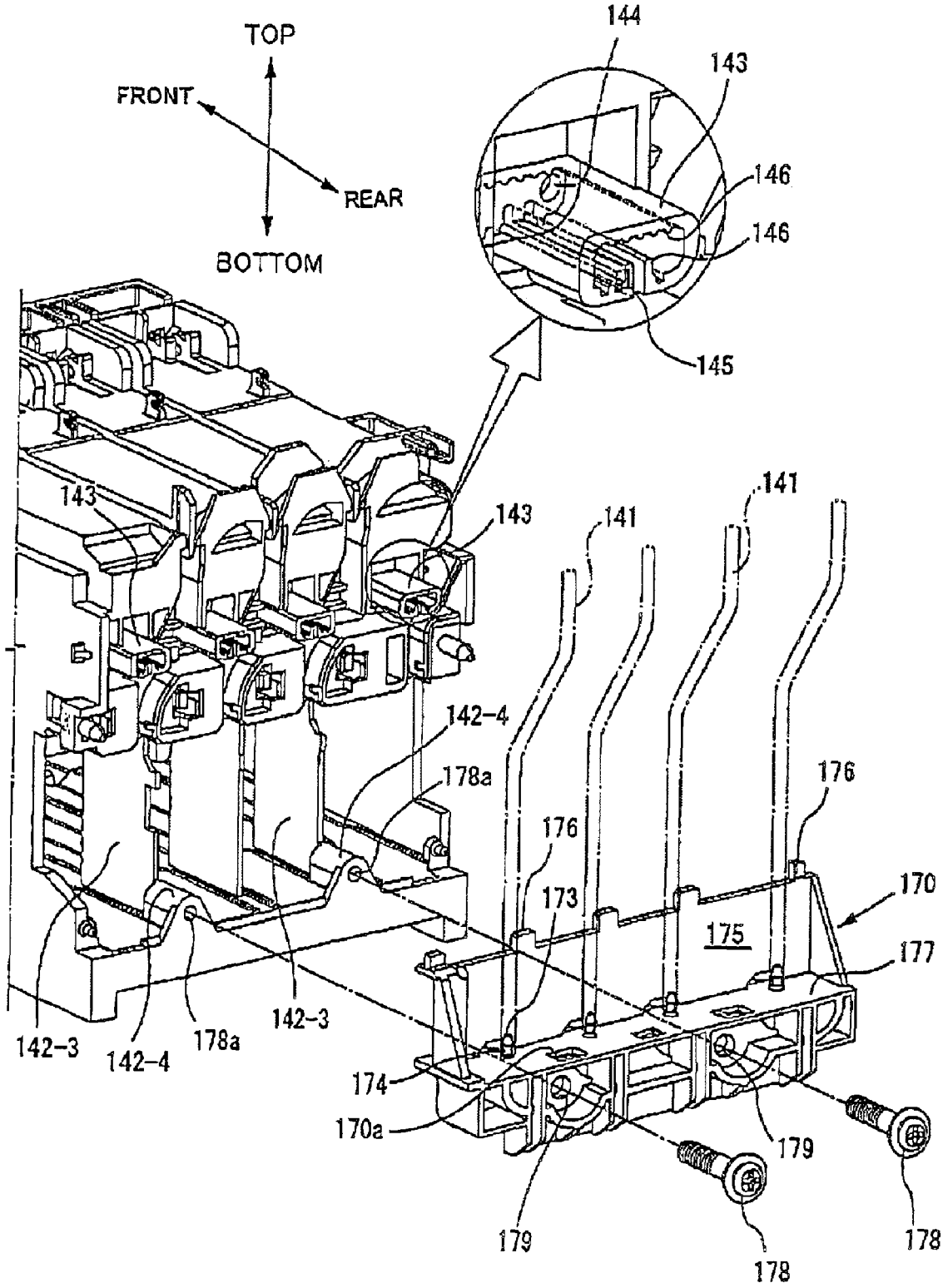
FIG. 9B is an exploded perspective view showing a state in which an elbow member is removed from the ink refilling unit in the embodiment of the present invention.
Figure 10:
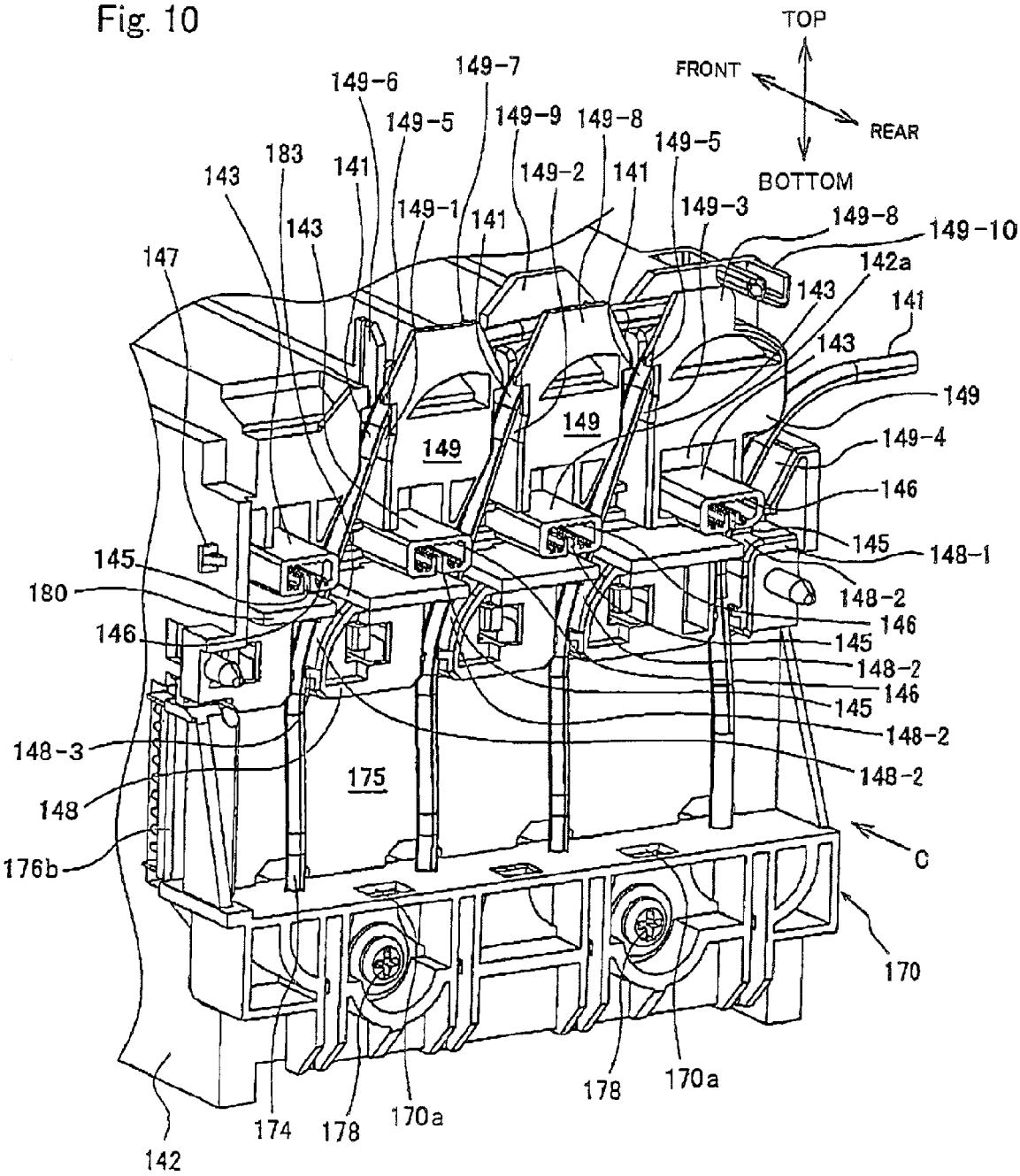
FIG. 10 is a perspective view showing a state in which the fixing plate is removed from the ink refilling unit in the embodiment of the present invention.

Further, on a rear wall 142*a* which is formed on an upper half portion of the rear side of the cartridge casing 142, as shown in FIG. 9A, FIG. 9B and FIG. 10, second guide portions 149 described later and proximal end portions of the atmospheric-pressure introducing sleeves 143, and first guide portions 148 described later are integrally formed.

Still further, as shown in FIG. 13, four laterally elongated holes are formed in the rear wall 142*a* in parallel between the atmospheric-pressure introducing sleeves 143 and the first guide portions 148. These laterally elongated holes constitute fitting windows 142-1 and, at the same time, connecting portions 142-2 are formed between the respective fitting windows 142-1.

The fitting windows 142-1 and the connecting portions 142-2 formed between the respective fitting windows 142-1 are provided, as described later, for mounting a leaked ink leading member 180 on the rear wall 142*a* of the cartridge casing 142.

As shown in FIG. 13, in a proximal end (ink cartridge 190 side) of each atmospheric-pressure introducing sleeve 143, a communication port 144 which allows the inside of the atmospheric-pressure introducing sleeve 143 and the atmospheric-pressure introducing port 193 of the ink cartridge 190 to communicate with each other is formed. On the other hand, in a bottom surface portion of a distal end portion (a side opposite to the ink cartridge 190) of each atmospheric-pressure introducing sleeve 143, a slit 145 which allows the inside and the outside of the atmospheric-pressure introducing sleeve 143 to communicate with each other is formed along the longitudinal direction of the atmospheric-pressure introducing sleeve 143.

A plurality of ribs 146, which extends toward the distal end side along the longitudinal direction of the atmospheric-pressure introducing sleeve 143 from the communication port 144 side, is formed on an inner wall of the atmospheric-pressure introducing sleeve 143. Due to the provision of the ribs 146, a capillary phenomenon is induced and hence, ink which leaks into the inside of the atmospheric-pressure introducing sleeve 143 from the atmospheric-pressure introducing port 193 is surely led to an ink absorber 160 (see FIG. 9A and FIG. 14).

Figure 14:
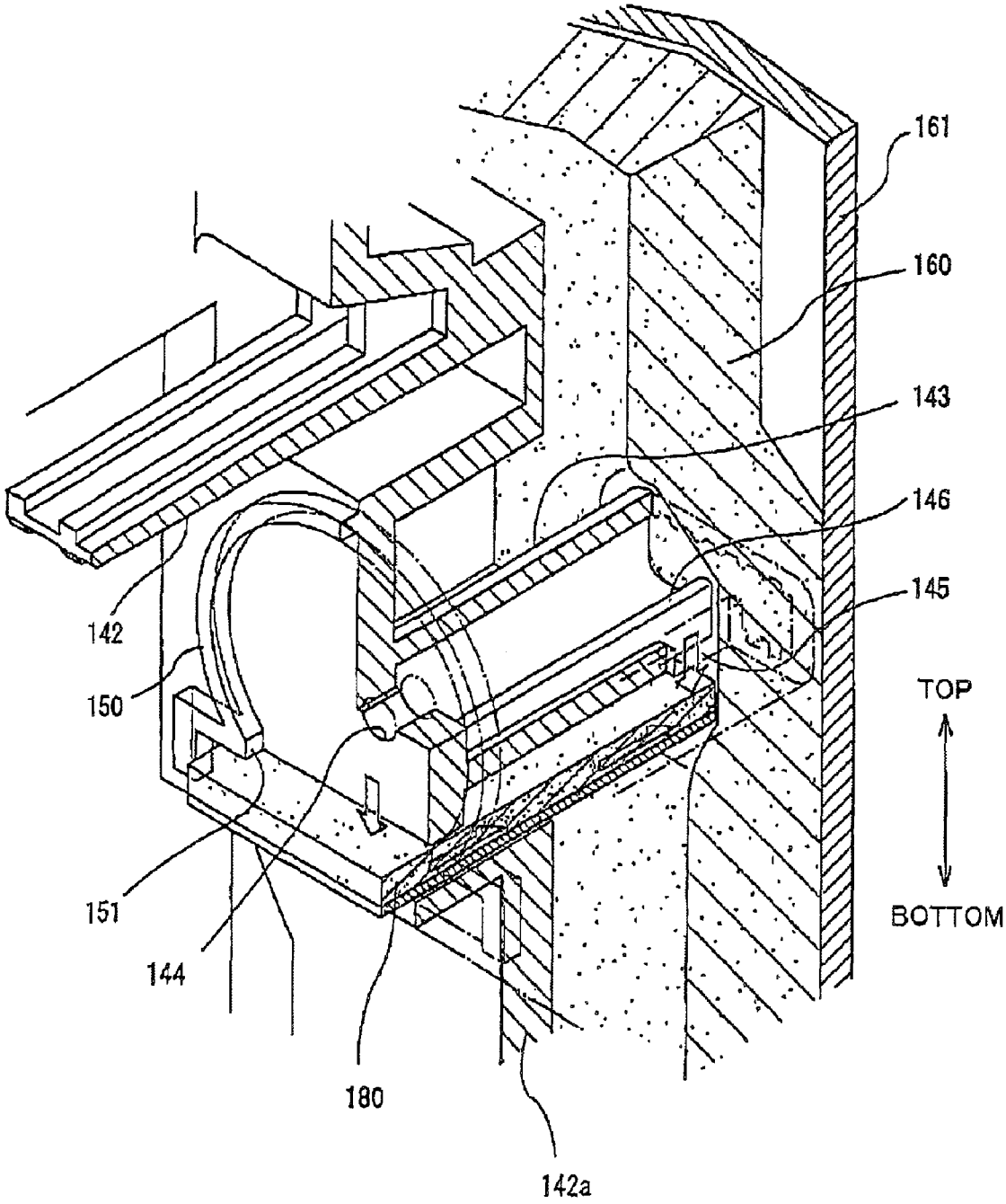
FIG. 14 is an enlarged perspective view of a portion G in FIG. 7.

As shown in FIG. 7 and FIG. 14, the ink absorber 160 is configured to contact a distal end side of the atmospheric-pressure introducing sleeve 143 and the leaked ink leading member 180 and absorb ink leaked from the atmospheric-pressure introducing port 193. Here, the ink absorber 160 may be formed of a porous material such as sponge, urethane foam, fibers, and non-woven fabric and hence, the ink absorber 160 can absorb ink by sucking and holding ink in an innumerable number of small pores formed in the inside of the ink absorber 160 and small interstices defined between fibers.

As shown in FIG. 9A, the ink absorber 160 is assembled to the rear side of the cartridge casing 142 by a fixing plate 161 and a frame body 162.

To be more specific, as shown in FIG. 7 and FIG. 9A, the ink absorber 160 and the fixing plate 161 have a rectangular-plate shape. The frame body 162 having a picture-frame-like shape projects around the fixing plate 161. The fixing plate 161 and the frame body 162 is referred to as an ink absorber casing. The ink absorber 160 is housed in the inside of the ink absorber casing. As shown in FIG. 7, FIG. 9A and FIG. 14, the ink absorber 160 comes into contact with the projecting distal ends of the atmospheric-pressure introducing sleeves 143 when the ink absorber 160 fitted in the ink absorber casing is assembled to the rear side of the cartridge casing 142.

Figure 5:
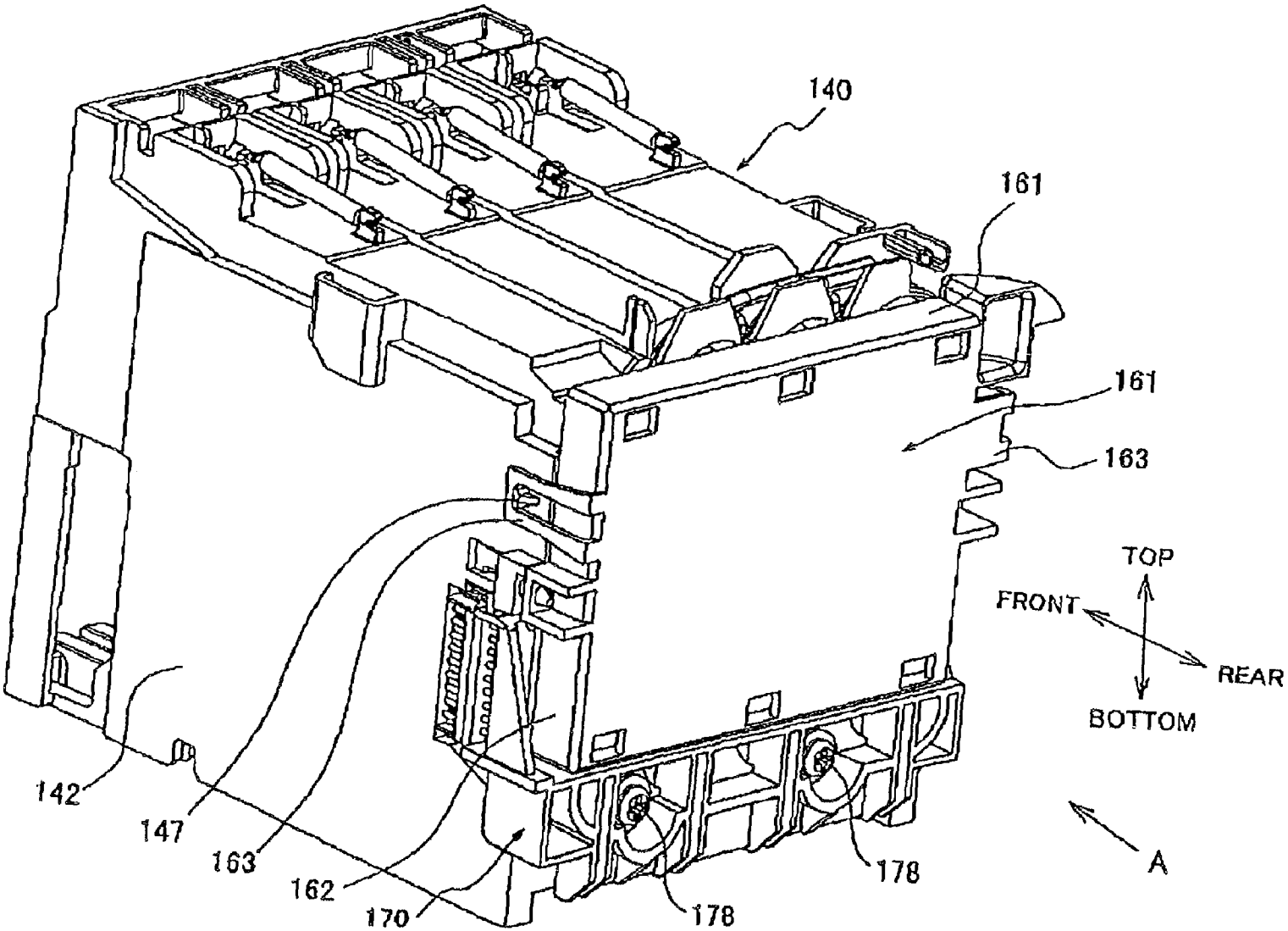
FIG. 5 is a perspective view of the ink refilling unit according to the embodiment of the present invention.

As shown in FIG. 5 and FIG. 9A, on both left and right outer sides of the frame body 162, engaging arm portions 163 are formed. As shown in FIG. 5 and FIG. 9A, these engaging portions 163 are engaged with engaging projecting portions 147 which are formed on an outer wall of the cartridge casing 142 in a projecting manner. Further, as shown in FIG. 9A, on an outer surface of a bottom portion of the frame body 162, engaging projecting portions 164 which extend downwardly are formed. These engaging projecting portions 164 are engaged with engaging holes 170*a* formed in a mounting member 177 of an elbow member 170 described later.

Figure 20:
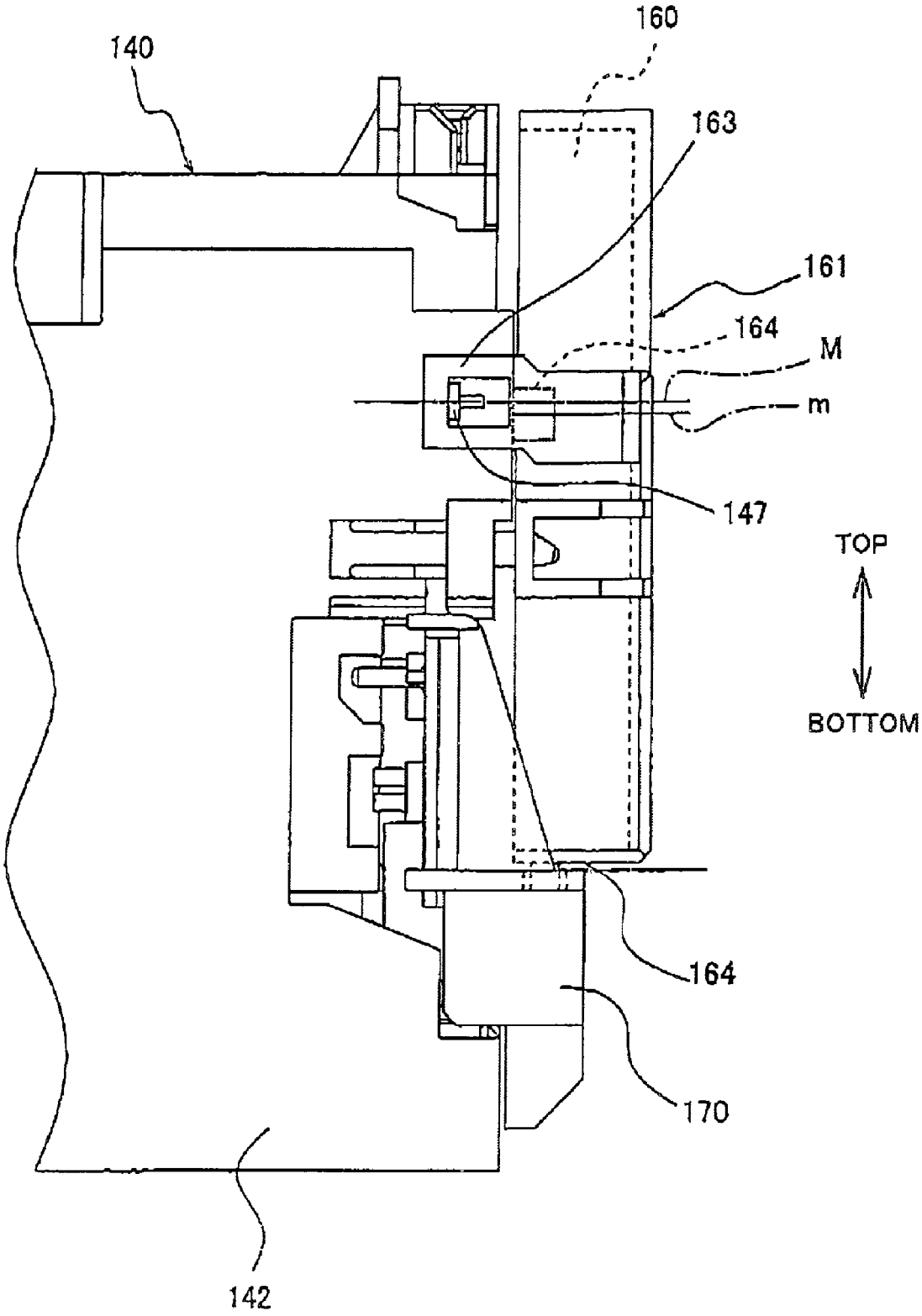
FIG. 20 is a side view of the ink refilling unit according to the embodiment of the present invention.

Further, as shown in FIG. 20, the center M of the engaging projecting portion 147 of the cartridge casing 142 is offset upwardly from the center m of the atmospheric-pressure introducing sleeves 143 and, at the same time, the engaging hole 170*a* of the elbow member 170 is positioned below the center m of the atmospheric-pressure introducing sleeves 143.

Figure 6:
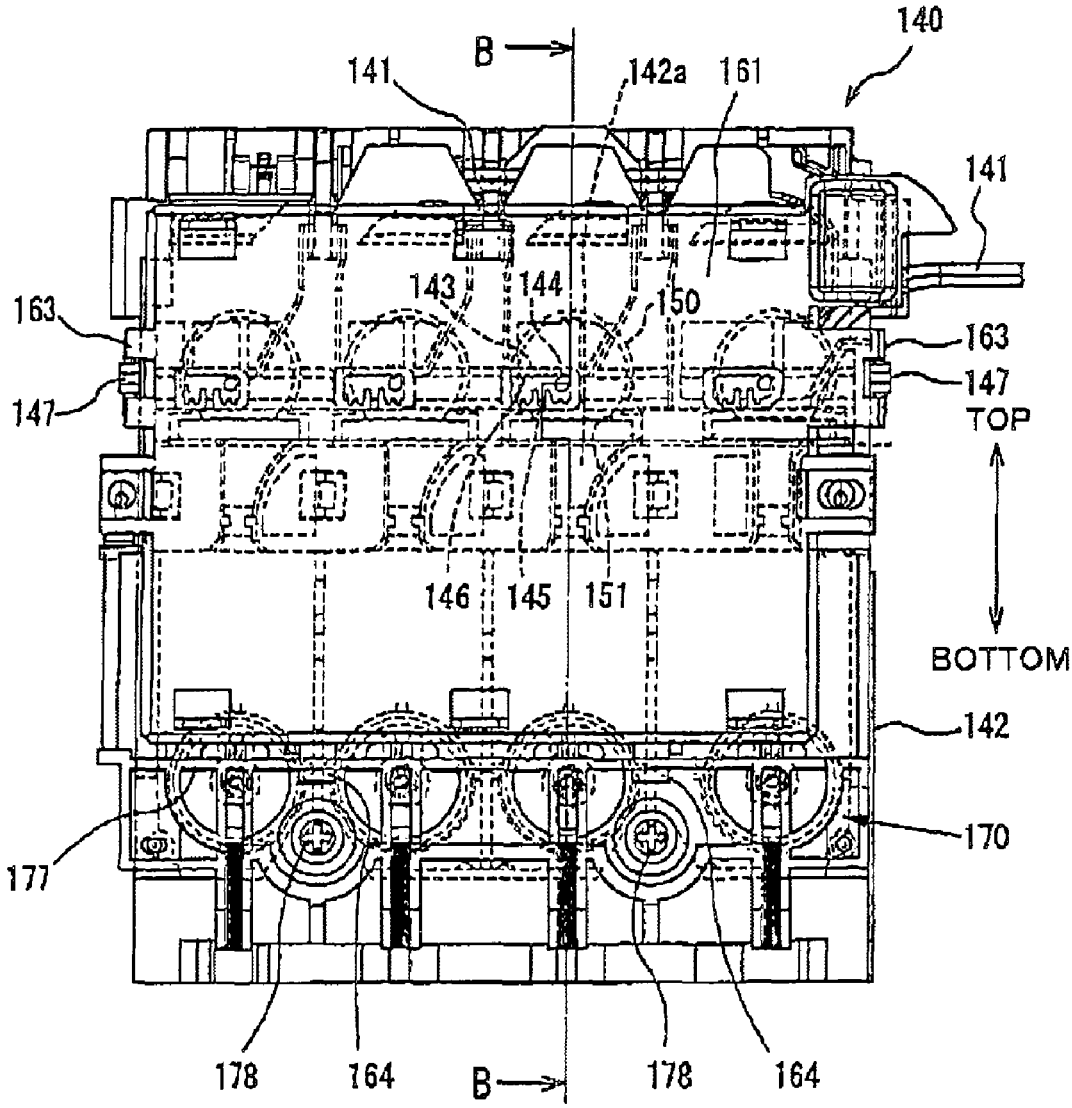
FIG. 6 is a back view of the ink refilling unit viewed in the direction of an arrow A in FIG. 5.

Further, as shown in FIG. 7, the elbow member 170 is mounted in a portion of the cartridge casing 142 which corresponds to the discharge ports 192 of the ink cartridges 190, that is, in a lower-side portion of the cartridge casing 142. The elbow member 170 is configured to turn the flow direction of ink discharged from the discharge ports 192 by approximately 90°. In this embodiment, as shown in FIG. 5 and FIG. 6 and FIG. 9A, the elbow member 170 is fixed to the cartridge casing 142 using bolts 178.

Figure 16:
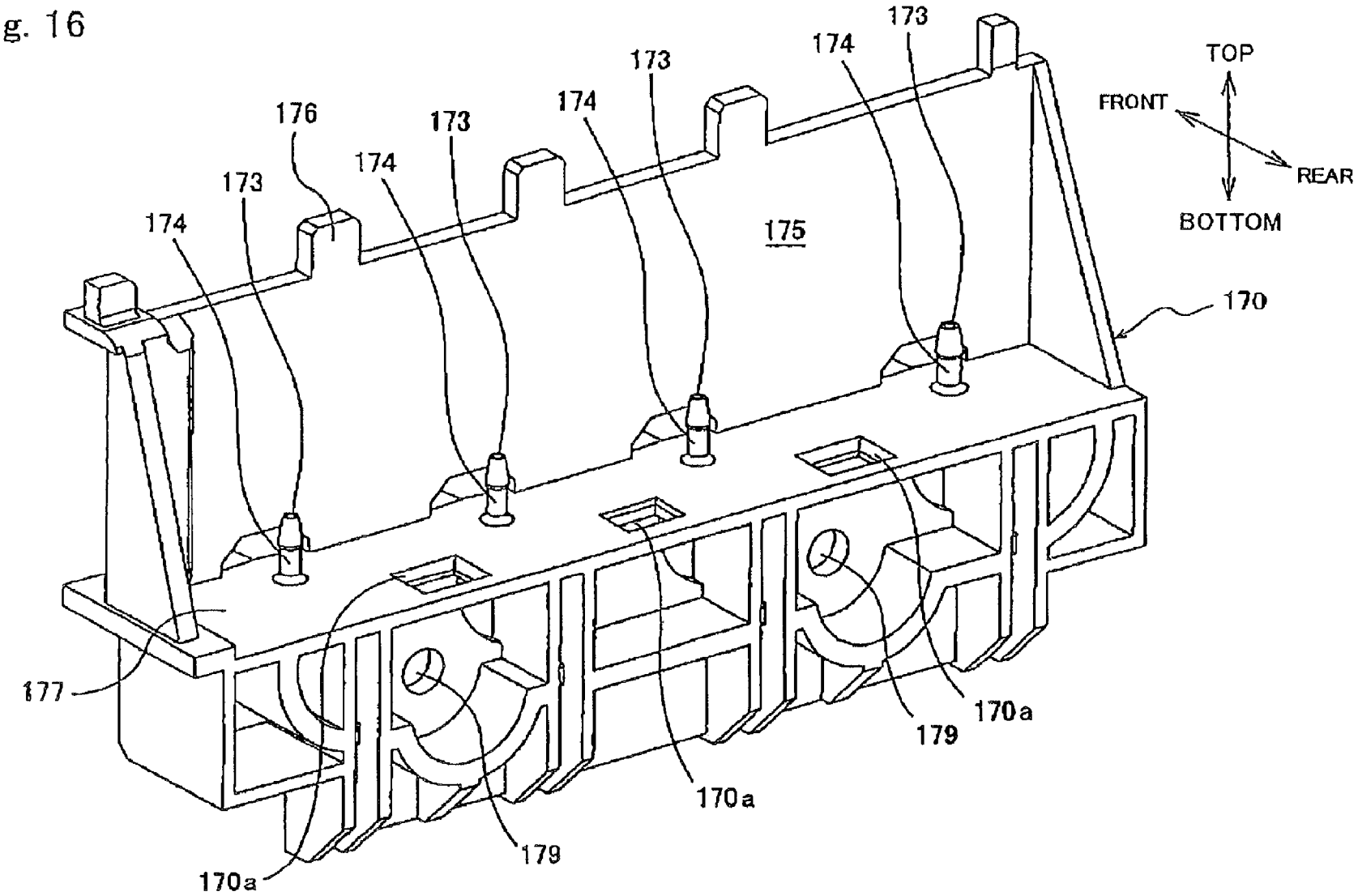
FIG. 16 is a perspective view in which an elbow member according to the embodiment of the present invention is viewed from rear.
Figure 17:
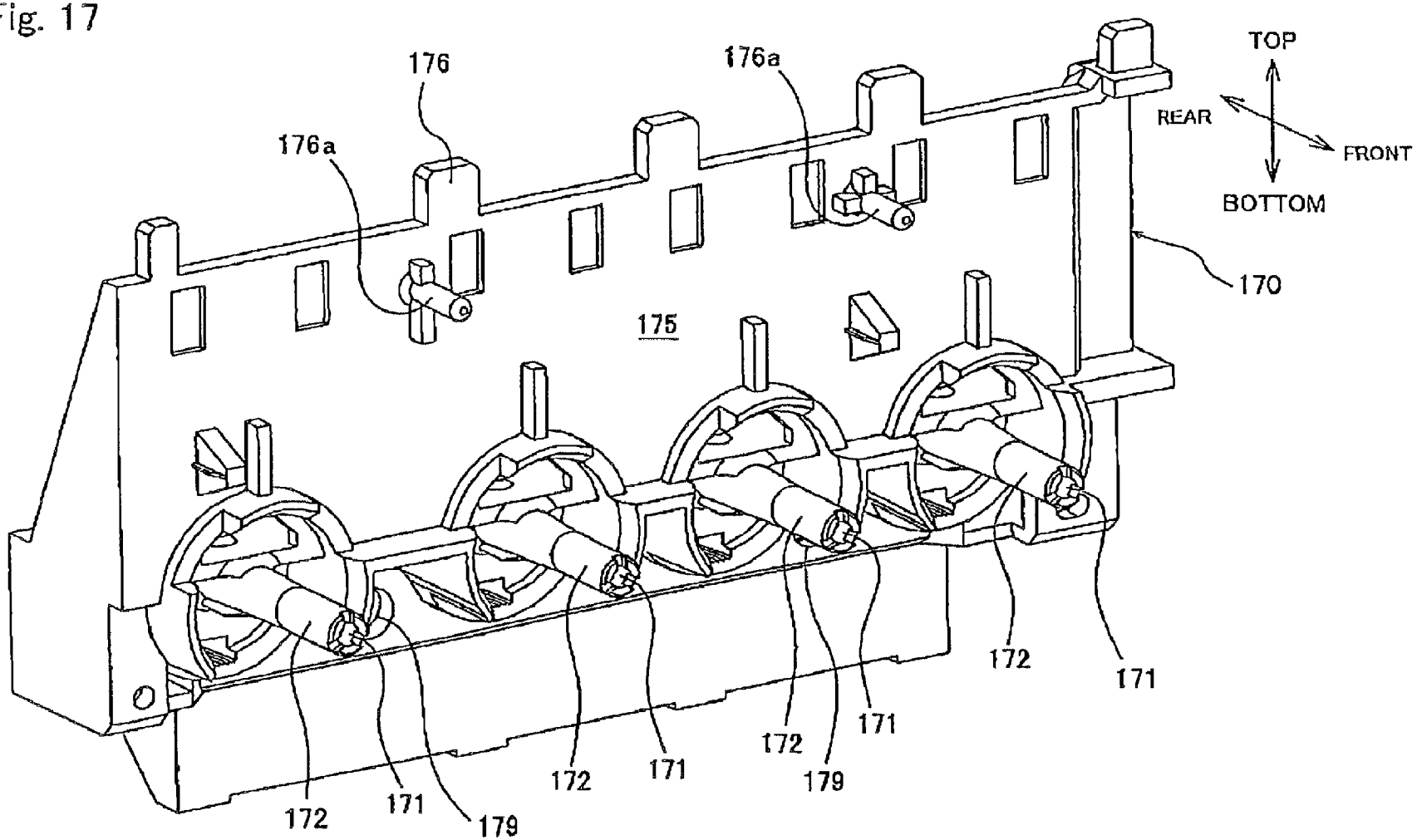
FIG. 17 is a perspective view in which the elbow member according to the embodiment of the present invention is viewed from front.
Figure 18:
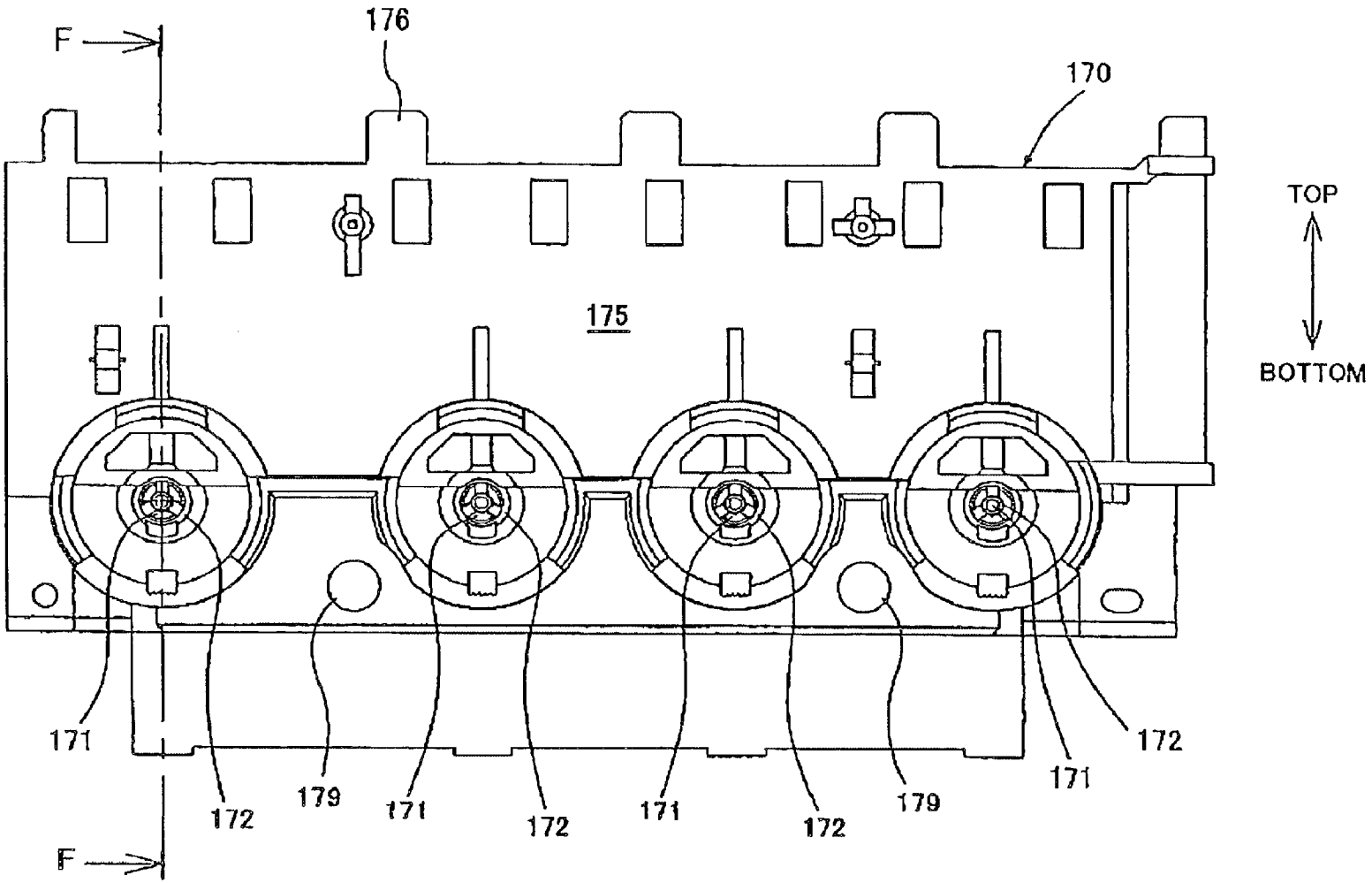
FIG. 18 is a front view of the elbow member according to the embodiment of the present invention.

As shown in FIG. 16 to FIG. 18, the elbow member 170 is constituted of a laterally-extending vertical plate 175 which includes, on an upper end thereof, upwardly-projecting mounting lugs 176, a laterally-extending horizontal mounting member 177 which is integrally connected to a lower end of the vertical plate 175, horizontally-extending cartridge-side needles 172 which are mounted on the mounting member 177 in a projecting manner toward the ink cartridge side, and vertically-extending tube-side needles 174 which have distal ends thereof projecting from a horizontal upper surface of the mounting member 177 and communicate with rear ends of the needles 172 in an approximately L-shape. In the drawing, mounting holes 179 are formed in a lower portion of the mounting member 177 for fixing the elbow member 170 to the cartridge casing 142 by fastening using the bolts 178.

In mounting the elbow member 170 on the cartridge casing 142, as shown in FIG. 9B, first of all, the elbow member 170 is brought into contact with a lower half portion of the rear side of the cartridge casing 142 such that the cartridge-side needles 172 are directed toward the ink cartridges 190 (not shown in FIG. 9B). Next, the mounting lugs 176 formed on the upper end of the vertical plate 175 are fitted into insertion holes (not shown in the drawings) formed in lower surfaces of first guide portions 148 formed on the rear side of the cartridge casing 142. At the same time, as shown in FIG. 9B, FIG. 12 and FIG. 13, female threaded holes 178*a* which are formed in end surfaces of the elbow member mounting projecting portions 142-4 and mounting holes 179 formed in the mounting members 177 of the elbow member 170 are aligned with each other, and the elbow member 170 and the cartridge casing 142 are fixed to each other by fastening using the bolts 178 (see FIG. 9B and FIG. 10).

Figure 19:
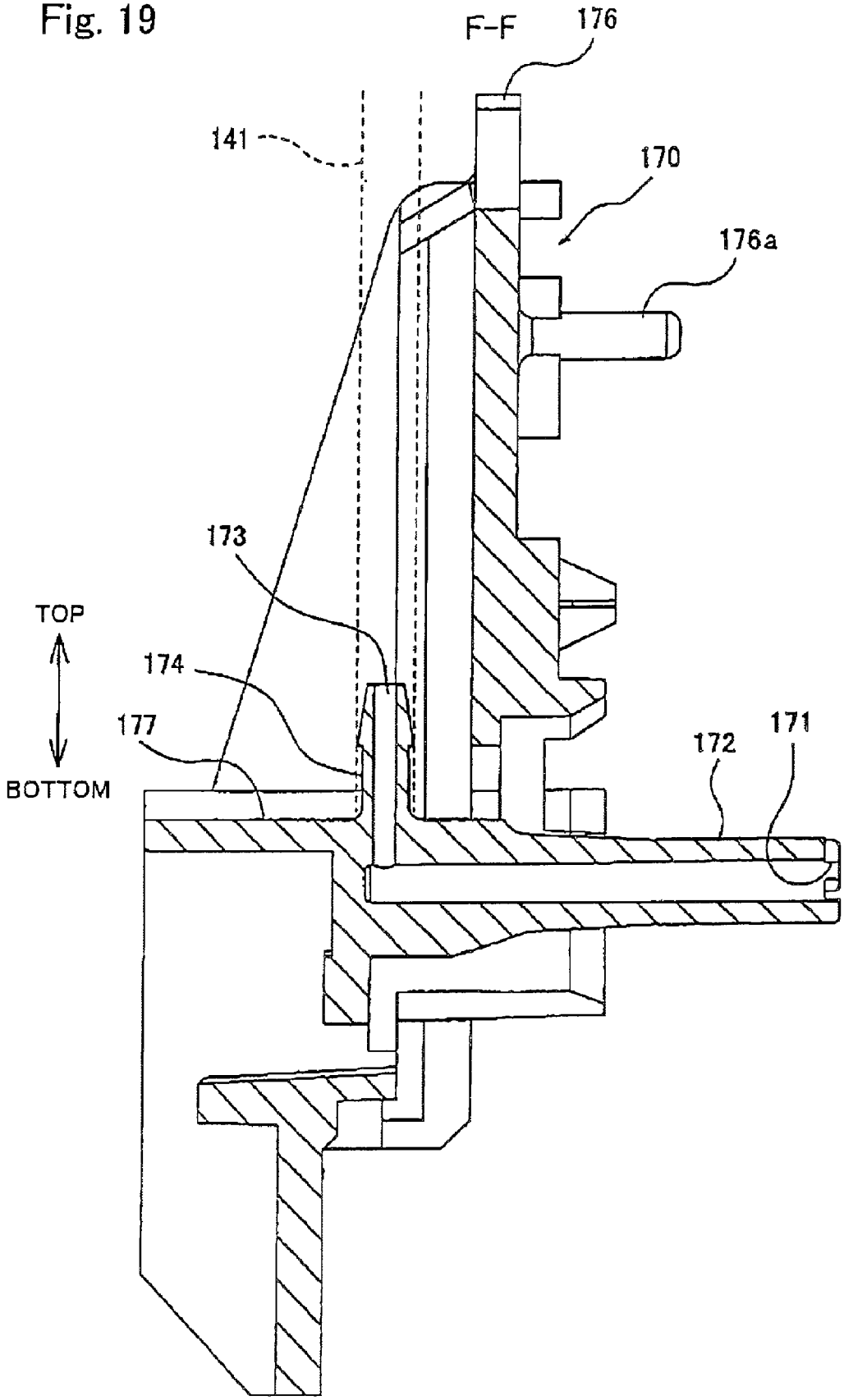
FIG. 19 is a cross-sectional view taken along a line F-F in FIG. 18.

As shown in FIG. 19, an ink flow passage ranging from the ink inlet port 171 to the ink outlet port 173 is formed of a passage which is bent in an approximately L shape in the inside of the elbow member 170. Here, one end of the ink tube 141 is connected to the tube-side needle 174.

In this manner, the elbow member 170 includes ink inlet ports 171 which communicate with the discharge ports 192 of the ink cartridges 190 and the ink outlet ports 173 which open toward the atmospheric-pressure introducing sleeve 143. That is, the ink flow passage which allows communications between the ink inlet ports 171 and the ink outlet ports 173 is bent in an approximately L-shape.

Figure 11:
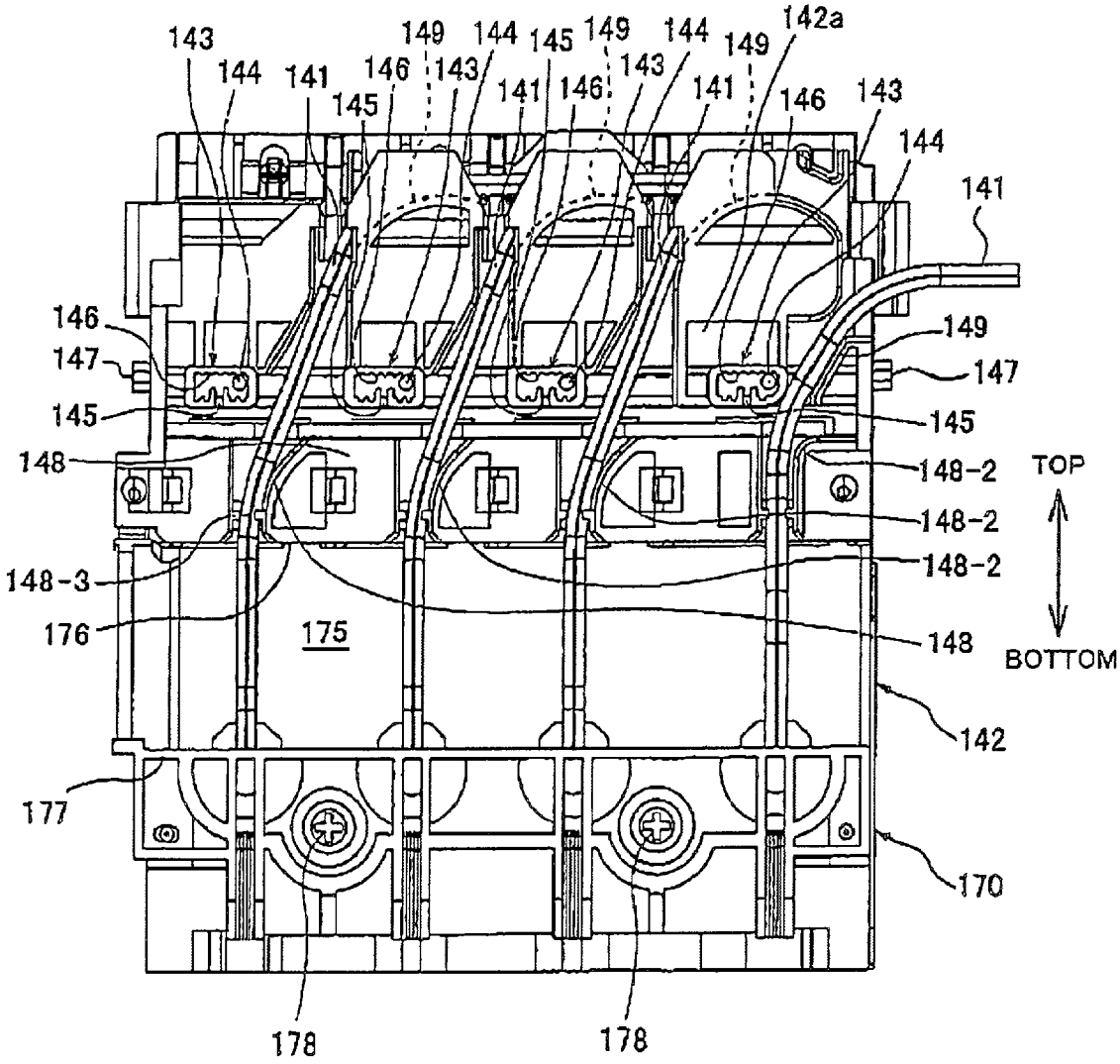
FIG. 11 is a back view of the ink refilling unit in a state that the fixing plate is removed, viewed in the direction of an arrow C in FIG. 10 (*a*)

Further, as shown in FIG. 10 and FIG. 11, the ink tubes 141, which are connected to the tube-side needles, pass positions offset from the atmospheric-pressure introducing sleeves 143, that it, the ink tubes 143 pass through recessed portions defined between the atmospheric-pressure introducing sleeves 143, and extend toward the image recording part 110 (recording head 111) along the outer wall of the cartridge casing 142, and the ink tubes 141 are connected to the image recording part 110 at the other end.

In other words, the ink tubes 141, which are connected to the tube-side needles 174 at one end, pass positions corresponding to spaces defined between the ink cartridges 190, that is, positions corresponding to corner portions (portions A in FIG. 8) of the ink tank portions 191 as viewed in the projecting direction of the atmospheric-pressure introducing sleeves 143, and extend along the outer wall of the cartridge casing 142 toward the image recording part 110 (recording head 111), and the ink tubes 141 are connected to the image recording part 110 at the other end.

Upper ends of the tube-side needles 174, which form an L shape with the cartridge-side needles 172 and extend upwardly, project from the upper surface of the mounting member 177, and proximal opening portions of the ink tubes 141 communicate with the projecting upper ends of the tube-side needles 174 by fitting and hence, the ink tubes 141 are led upwardly using the projecting upper ends of the tube-side needles 174 as starting points.

That is, as shown in FIG. 9A and FIG. 10, the ink tubes 141 are led to the image recording part 110 by way of the upper ends of the tube-side needles 174, the first guide portions 148, tube insertion notched portions 183 formed in the leaked ink leading member 180, the gaps defined between the respective atmospheric-pressure introducing sleeves 143 and gaps defined between the second guide portions 149.

Further, in FIG. 17, numeral 176*a* indicates sensor mounting rods which are mounted on a front surface of an upper portion of the vertical plate 175 of the elbow member 170. In mounting and fixing an electronic board 176*b* (see FIG. 10) which includes the ink residual quantity detection sensor 199 to the cartridge casing 142, the electronic board 176*b* is sandwiched between the elbow member 170 and rear end surfaces of the partition vertical plates 142-3 arranged on the rear side of the cartridge casing 142, and the sensor mounting rods 176 are inserted into insertion holes (not shown in the drawing) formed in the electronic board 176*b*.

Below the atmospheric-pressure introducing sleeves 143 and above the ink outlet ports 173 formed in the elbow member 170, that is, between the distal end portions of the atmospheric-pressure introducing sleeves 143 and the ink outlet ports 173, as shown in FIG. 11, the first guide portions 148 each having a curved surface which guides the extending direction of the ink tubes 141 are formed. Accordingly, the ink tubes 141 are slightly curved rightward (see FIG. 11) along the curved surfaces of the first guide portions 148, extend upwardly, and pass between the respective distal ends of the neighboring atmospheric-pressure introducing sleeves 143.

That is, as shown in FIG. 9A to FIG. 13, three first guide portions 148 are formed in parallel on the rear wall 142*a* of the cartridge casing 142 in a projecting manner. An end guide projecting portion 148-1 is formed on one end of the first guide portions 148 in a projecting manner, and an end guide projecting portion is formed on the other end of the first guide portions 148. Here, the end guide projecting portion, the three first guide portions 148, and the end guide projecting portion 148-1 are arranged in parallel on the rear wall 142*a* of the cartridge casing 142.

As shown in FIG. 11 and FIG. 12, the first guide portions 148 are formed in a substantially rectangular cross-sectional shape as a whole. A rectangular end portion of each first guide portion 148 along which the corresponding ink tube 141 passes defines a curved receiving portion 148-2 having a round shape, and the curved receiving portion 148-2 is arranged at a position substantially right above the position of the corresponding tube-side needle 174 of the elbow member 170.

As shown in FIG. 11 and FIG. 12, predetermined gaps are respectively formed between the end guide projecting portion, the three first guide portions 148, and the end guide projecting portion 148-1. The ink tubes 141 pass through these gaps.

Further, projections 148-3 are respectively formed on the curved receiving portions 148-2 so as to project toward the gaps through which the ink tubes 141 pass. Further, at each projection 148-3, the gap through which the corresponding ink tube 141 passes is set smaller than a diameter of the ink tube 141. Accordingly, by pushing each ink tube 141 into a inner portion of the corresponding gap against a resilient force of the ink tube 141, each ink tube 141 can be fixedly fitted in the corresponding gap.

Further, on a side of the atmospheric-pressure introducing sleeves 143 opposite to the ink outlet ports 173, second guide portions 149 each having a curved surface which guides the extending direction of the ink tube 141 are formed on the rear wall 142*a* of the cartridge casing 142. Accordingly, the ink tubes 141 are guided (bent) in an inclined manner in the right upper direction by the first guide portions 148, and then guided (bent) in the substantially horizontal direction along the curved surfaces of the second guide portions 149.

The second guide portions 149 include, as shown in FIG. 10, guide portions 149-1, 149-2, 149-3 and 149-4. Each of the guide portions 149-1, 149-2, 149-3 includes a curved portion. The guide portion 149-4 includes an inclined flat portion. Predetermined gaps are formed between the guide portions 149-1, 149-2, 149-3 and 149-4. The ink tubes 141 pass through the gaps. Further, as described in conjunction with the projections 148-3 of the first guide portions 148, also in the second guide portions 149, projections 149-5 are formed on the guide portions 149-1, 149-2, and 149-3 so as to project toward the gaps through which the corresponding ink tubes 141 pass. At each projection 149-5, the gap through which the corresponding ink tube 141 passes is set smaller than a diameter of the ink tube 141 and the ink tube 141 is fixedly fitted in the corresponding gap by being pushed into a inner portion of the gap against the resilient force of the ink tube 141.

The projections 148-3 of the first guide portions 148 project in the lateral direction with respect to the ink tubes 141 which are pulled around the projections 148-3. The second guide portions 149 further include restricting plates 149-6, 149-7, and guide plates 149-8, 149-9, 149-10. That is, as shown in FIG. 9A and FIG. 10, on the rear wall 142*a* of the cartridge casing 142, the guide portion 149-1 is enclosed with the restricting plates 149-6, 149-7 projecting upward from the curved guide portion 149-1. At the same time, as shown in FIG. 9A and FIG. 9B, the curved guide portions 149-2, 149-3 are enclosed with the guide plates 149-8, 149-9 149-10 which project upward from the curved guide portions 149-2, 149-3. Accordingly, the ink tubes 141 guided along the curved guide portions 149-1, 149-2, 149-3 are held in place by the regulating plates 149-6, 149-7 and the guide plates 149-8, 149-9, 149-10.

Here, in this embodiment, as shown in FIG. 10, both of the first guide portions 148 and the second guide portions 149 are integrally formed with the cartridge casing 142.

Further, as shown in FIG. 7 and FIG. 14, the leaked ink leading member 180 is disposed in the cartridge casing 142 so that it is below the atmospheric-pressure introducing port 193. Here, the leaked ink leading member 180 is configured to receive ink leaked from the atmospheric-pressure introducing ports 193 and lead the ink to the ink absorber 160 arranged outside the cartridge casing 142. A distal end portion of the leaked ink leading member 180 is brought into contact with a surface of the ink absorber 160.

In this embodiment, to ensure the reliable contact of the leaked ink leading member 180 with the ink absorber 160, in a state that the leaked ink leading member 180 is assembled to the cartridge casing 142, a size of the leaked ink leading member 180 is set such that an end portion of the leaked ink leading member 110 is positioned on the same plane as the distal end of each atmospheric-pressure introducing sleeve 143 or on a side closer to the ink absorber 160 from the same plane.

Further, the leaked ink leading member 180 is formed of a porous material in the same manner as the ink absorber 160. In this embodiment, as shown in FIG. 15, one horizontally and laterally-elongated rectangular leaked ink leading member 180 is formed into one sheet by integrally connecting four leaked ink leading-member elements 182 which respectively correspond to the atmospheric-pressure introducing ports 193 (see FIG. 3) of the respective ink cartridges 190.

Figure 15:
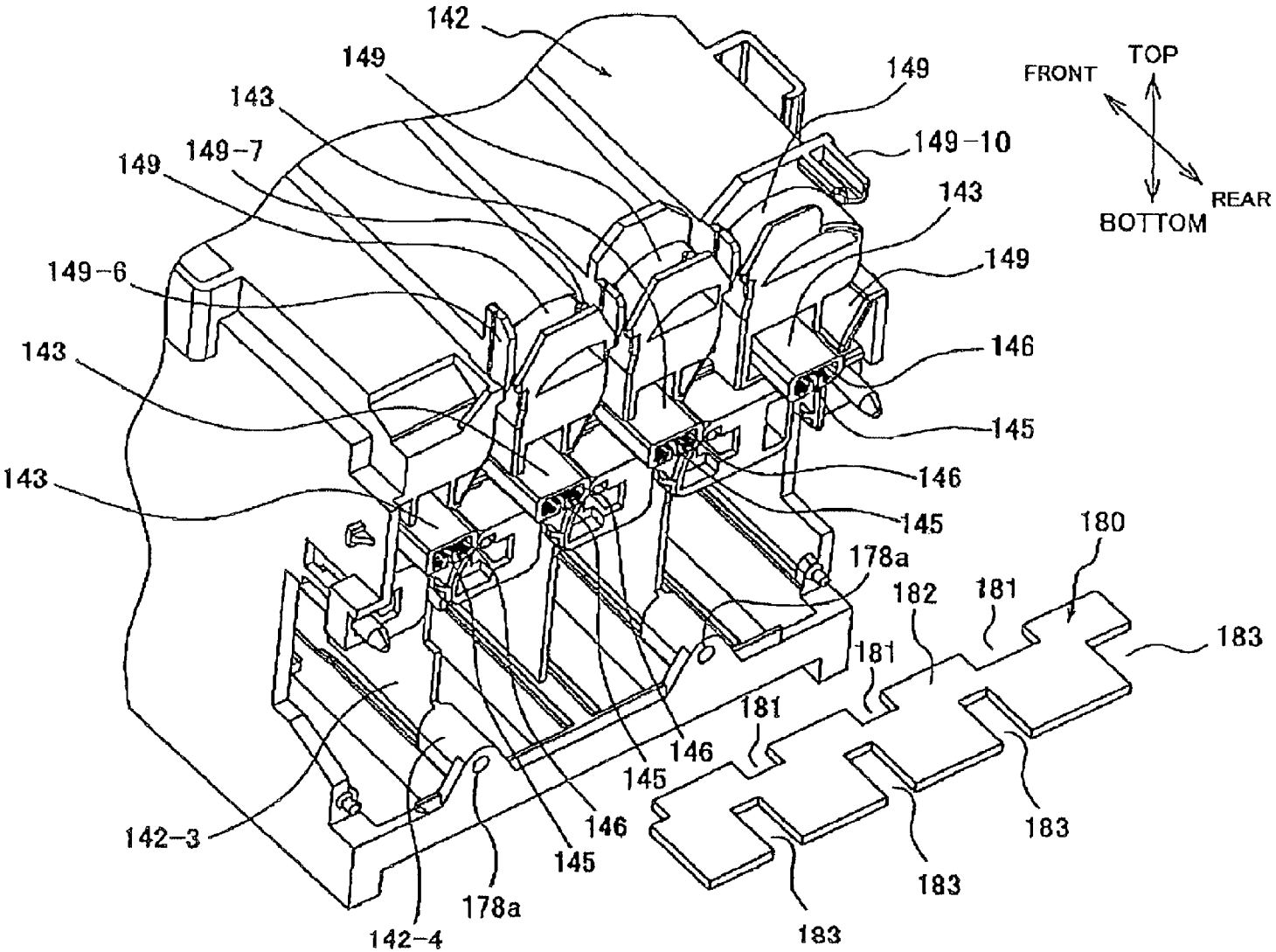
FIG. 15 is an exploded perspective view showing a state in which a leaked ink leading member is removed from the cartridge casing.

Here, in this embodiment, as shown in FIG. 15, for integrally forming four leaked ink leading-member elements 182, notched portions 181 are formed in predetermined portions of the leaked ink leading member 180. The leaked ink leading member 180 is fixed to the cartridge casing 142 by fitting the notched portions 181 into the fitting windows 142-1 (FIG. 13) and the connecting portions 142-2 (FIG. 13), which are formed on the rear wall 142*a* of the cartridge casing 142.

That is, as shown in FIG. 15, the leaked ink leading member 180 is formed in a horizontally rectangular plate shape, in which three notched portions 181 are formed in a front end of the leaked ink leading member 180 thus forming the leaked ink leading-member elements 182 between the notched portions 181 and, at the same time, four tube insertion notched portions 183 are formed at a rear end of the leaked ink leading member 180.

In horizontally mounting the leaked ink leading member 180 on the rear wall 142*a* of the cartridge casing 142, as shown in FIG. 7 and FIG. 10, the leaked ink leading member 180 is inserted into a space defined below the atmospheric-pressure introducing sleeves 143, so that the leaked ink leading-member elements 182 are fitted into the fitting windows 142-1 and the connecting portions 142-2, which are formed on the rear wall 142*a* of the cartridge casing 142.

Further, as shown in FIG. 10 and FIG. 11, the ink tubes 141, which extend upwardly from the upper ends of the tube-side needles 174 of the elbow member 170 and are led along the first guide portion 184, pass through the corresponding tube insertion notched portions 183, which are formed on the rear end of the leaked ink leading member 180, from below. Due to such an arrangement of ink tubes 141 which pass through the tube insertion notched portions 183, the leaked ink leading member 180 is fixed by being pushed from rear.

Further, as shown in FIG. 7 and FIG. 14, on a portion of the inner wall of the cartridge casing 142 which faces each atmospheric-pressure introducing port 193, arcuate wall portion 150 which projects toward the ink cartridge 190 is formed in a state that the wall portion 150 surrounds outer peripheral edge of the atmospheric-pressure introducing port 193. In a lower portion of the wall portion 150 which corresponds to the leaked ink leading member 180, a notched portion 151 is formed. The notched portion 151 is configured to discharge ink which stays in the inside of a space surrounded by the wall portion 150 to the leaked ink leading member 180.

3. Technical Feature of the Multifunctional Device 1 and the Ink Refilling Unit 140 of this Embodiment Each ink tube 141 possesses flexibility. However, when the ink tube 141 is bent and a radius of curvature of the ink tube 141 becomes small, a bending stress which occurs in a bent portion is increased. When the ink tubes 141 are arranged in place while remaining bent, cracks are liable to be easily generated at the bent portion and hence, a lifetime of ink tube 141 may be remarkably lowered.

On the other hand, when the cartridge casing 142 and the image recording part 110 are arranged close to each other, it is extremely difficult to arrange (pull around) the ink tubes 141 by bending with a sufficiently large radius of curvature.

To the contrary, in this embodiment, a flow passage of the ink supplied from each ink cartridge 190 is turned by approximately 90° using the elbow member 170 and hence, it is possible to turn the ink flow passage with a remarkably large radius of curvature compared with a case in which the ink tube 141 is bent to turn the ink flow passage by approximately 90°.

That is, when the elbow member 170 is not provided, an ink outlet port corresponding to the ink cutlet port 173 may be formed on another end of the cartridge-side needle 172 in a horizontal state by way of a connector, and the ink tube 141 may be connected to the ink inlet port 171 and hence, the ink tube 141 may be turned with a remarkably small radius of curvature. To the contrary, according to this embodiment, with the provision of the elbow member 170, it is possible to turn the ink flow passage with the remarkably large radius of curvature.

Further, as shown in FIG. 10 and FIG. 11, the ink tubes 141 which are connected to the elbow member 170 are arranged (pulled around) such that the ink tubes 141 pass through the gaps between the plurality of atmospheric-pressure introducing sleeves 143, for example, and extend toward the image recording part 110 side along an outer wall of the cartridge casing 142. Accordingly, it is possible to decrease a size of a gap between the outer wall of the cartridge casing 142 and other devices such as a waste ink box 118 (see FIG. 4). Accordingly, this embodiment can realize the further miniaturization of the multi-functional device 1.

Further, in this embodiment, as shown in FIG. 11, the first guide portions 148 having curved shapes are arranged below the atmospheric-pressure introducing sleeves 143 along the rear wall 142*a* of the cartridge casing 142 and the ink tubes 141 are brought into contact with the first guide portions 148. Accordingly, the ink tubes 141 extend in the direction toward the image recording part 110 while being guided by the first guide portions 148. Accordingly, it is possible to prevent the ink tubes 141 from being damaged due to the excessive bending of the ink tubes 141 at the first guide portions 148.

In this manner, this structure can prevent the generation of the excessively large bending force on the ink tubes 141 while realizing the further miniaturization of the multi-functional device 1.

Further, in this embodiment, as shown in FIG. 10 and FIG. 12, the second guide portions 149 having curved portions are arranged along the rear wall 142*a* of the cartridge casing 142 at positions obliquely upward from the atmospheric-pressure introducing sleeves 143 and the ink tubes 141 are brought into contact with the second guide portions 149. Accordingly, after the ink tubes 141 are guided by the first guide portions 148, the ink tubes 141 extend upwardly while passing positions offset from the atmospheric-pressure introducing sleeves 143 at the second guide portions 149 and hence, the ink tubes 141 reach the image recording part 110 without being excessively curved. Accordingly, it is possible to prevent the ink tubes 141 from being damaged due to the excessive curving of the ink tubes 141.

In this manner, this structure can prevent the generation of an excessively large bending stress in the ink tubes 141 while realizing the further miniaturization of the multi-functional device 1.

Further, in this embodiment, the multi-functional device 1 includes the leaked ink leading member 180 which receives ink leaked from the atmospheric-pressure introducing port 193 and leads the ink to the outside of the cartridge casing 142. Accordingly, the ink leaked from the atmospheric-pressure introducing port 193 is led to the outside of the cartridge casing 142 through the leaked ink leading member 180. Accordingly, the ink leaked from the atmospheric-pressure introducing port 193 can be prevented from adhering to an outer surface of the ink cartridge 190.

Further, the leaked ink leading member 180 is made of a porous material and hence, the leaked ink leading member 180 can hold the received ink in the inside thereof. Accordingly, the leaked ink leading member 180 can surely prevent the ink leaked from the atmospheric-pressure introducing port 193 from flowing to the outer surface of the ink cartridge 190.

Accordingly, in this embodiment, the ink leaked from the atmospheric-pressure introducing port 193 can be surely prevented from adhering to the outer surface of the ink cartridge 190 and hence, the occurrence of drawbacks including a drawback that a hand of the user is stained with ink leaked from the atmospheric-pressure introducing port 193 or a drawback that the adhesion of ink to the outer surface of the ink cartridge can be prevented in advance.

Further, in this embodiment, as shown in FIG. 7 and FIG. 14, the multi-functional device 1 includes the ink absorber 160 which absorbs the ink led by the leaked ink leading member 180. Accordingly, ink leaked from the atmospheric-pressure introducing port 193 is led to the outside of the cartridge casing 142 by the leaked ink leading member 10 and is absorbed by the ink absorber 160.

Accordingly, the ink leaked from the atmospheric-pressure introducing port 193 can be surely prevented from overflowing from the leaked ink leading member 180 and flowing to the outer surface of the ink cartridge 190 and hence, the ink can be prevented from adhering to the outer surface of the ink cartridge 190.

As an additional advantageous effect, as shown in FIG. 7 and FIG. 14, even when the ink residual quantity detection sensor 199 that detects a quantity of ink remaining in the ink tank portion 191 is arranged below the leaked ink leading member 180, the ink residual quantity detection sensor 199 can be prevented from being stained with ink leaked from the atmospheric-pressure introducing port 193. Accordingly, the malfunction of the ink residual quantity detection sensor 199 can be prevented from occurring.

Further, in this embodiment, as shown in FIG. 14, the wall portion 150 which projects toward the ink cartridge 190 is formed on the cartridge casing 142 so as to face the atmospheric-pressure introducing port 193, so that the wall portion 150 surrounds the outer peripheral edge of the atmospheric-pressure introducing port 193 and hence, ink leaked from the atmospheric-pressure introducing port 193 is stopped by the wall portion 150. Accordingly, ink adhering to the cartridge casing 142 can be prevented from being scattered when the ink cartridge is mounted in the cartridge casing 142.

Further, as shown in FIG. 14, the notched portion 151 is formed in a portion of the wall portion 150 which corresponds to the leaked ink leading member 180 and hence, ink stopped by the wall portion 150 can be discharged to the leaked ink leading member 180.

Accordingly, the residue of the ink adhering to the cartridge casing 142 can be reduced and hence, ink can be surely prevented from being scattered when the ink cartridges 190 are inserted into the cartridge casing 142 next time.

Further, as shown in FIG. 7 and FIG. 14, the ink jet recording apparatus is configured such that distal ends of the atmospheric-pressure introducing sleeves 143 and the leaked ink leading member 180 are brought into contact with the ink absorber 160 in a state that the ink absorber 160 is assembled to the cartridge casing 142. Accordingly, ink that is leaked from the atmospheric-pressure introducing port 193 and flows into the atmospheric-pressure introducing sleeves 143 or the leaked ink leading member 180 can be surely absorbed by the ink absorber 160 and hence, ink leaked from the atmospheric-pressure introducing port 193 can be surely prevented from adhering to the outer surface of the ink cartridge 190.

Further, in this embodiment, as shown in FIG. 14, a slit 145 is formed in a bottom surface of the atmospheric-pressure introducing sleeve 143 in the longitudinal direction to allow the inside and the outside of the atmospheric-pressure introducing sleeve 143 to communicate with each other. Accordingly, even in a state that the distal ends of the atmospheric-pressure introducing sleeves 143 are brought into contact with the ink absorber 160, an atmospheric pressure can be surely led into the atmospheric-pressure introducing ports 193 and hence, ink can be smoothly discharged.

In this embodiment, as shown in FIG. 9A and FIG. 20, the fixing plate 161 is connected to both side walls of the cartridge casing 142 at the rear side using left and right engaging arms 163. Accordingly, even when the fixing plate 161 is strongly pushed to bring the ink absorber 160 into contact with the atmospheric-pressure introducing sleeves 143, deformation and inclination of the fixing plate 161 can be prevented and hence, the ink absorber 160 can be surely brought into contact with the atmospheric-pressure introducing sleeves 143.

(Detailed Explanation of Constitutional Features of Ink Absorber Which Constitutes the Gist of the Present Invention)

Figure 24:
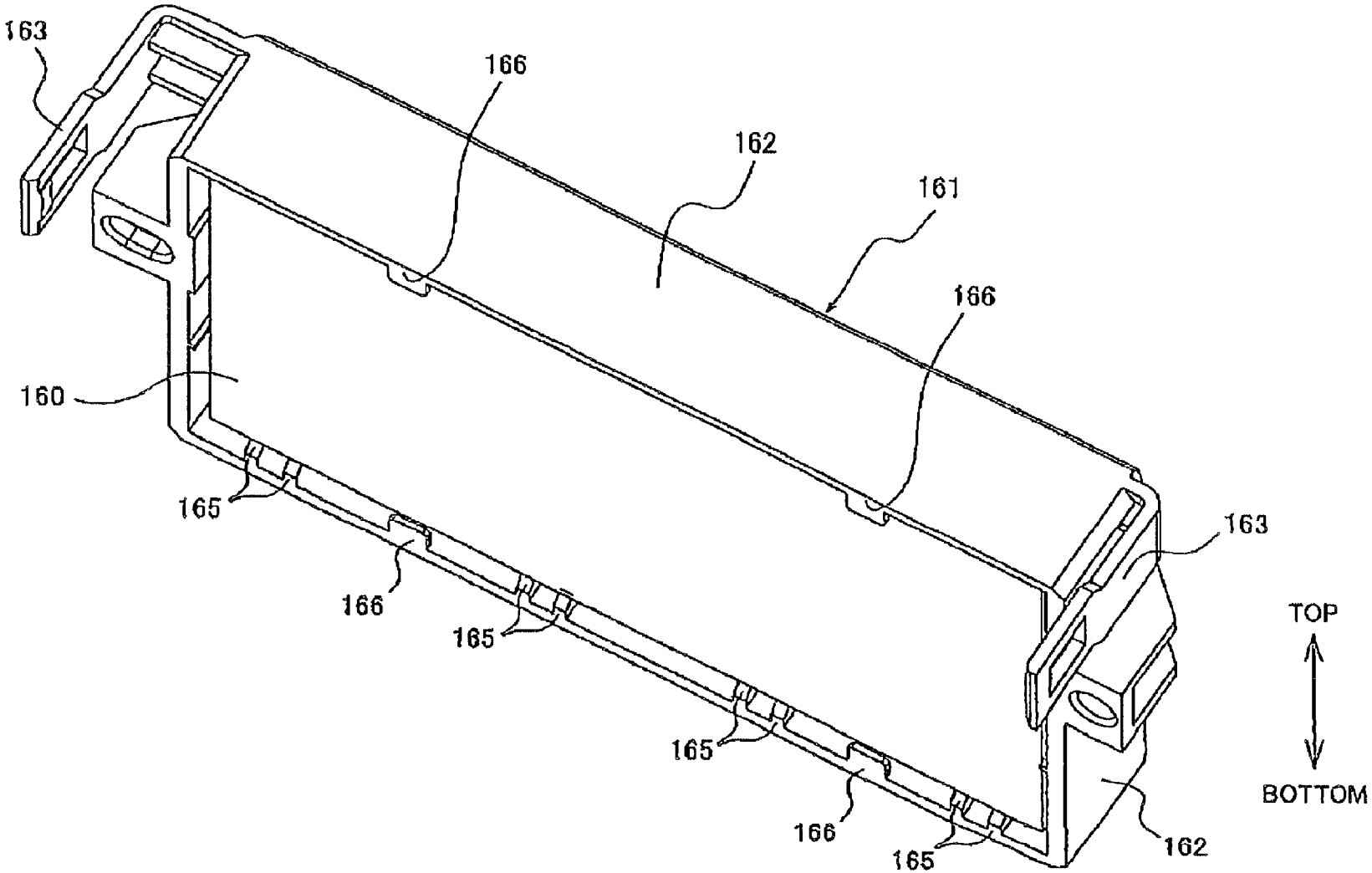
FIG. 24 is a perspective view of the fixing plate showing in FIG. 23.
Figure 25:
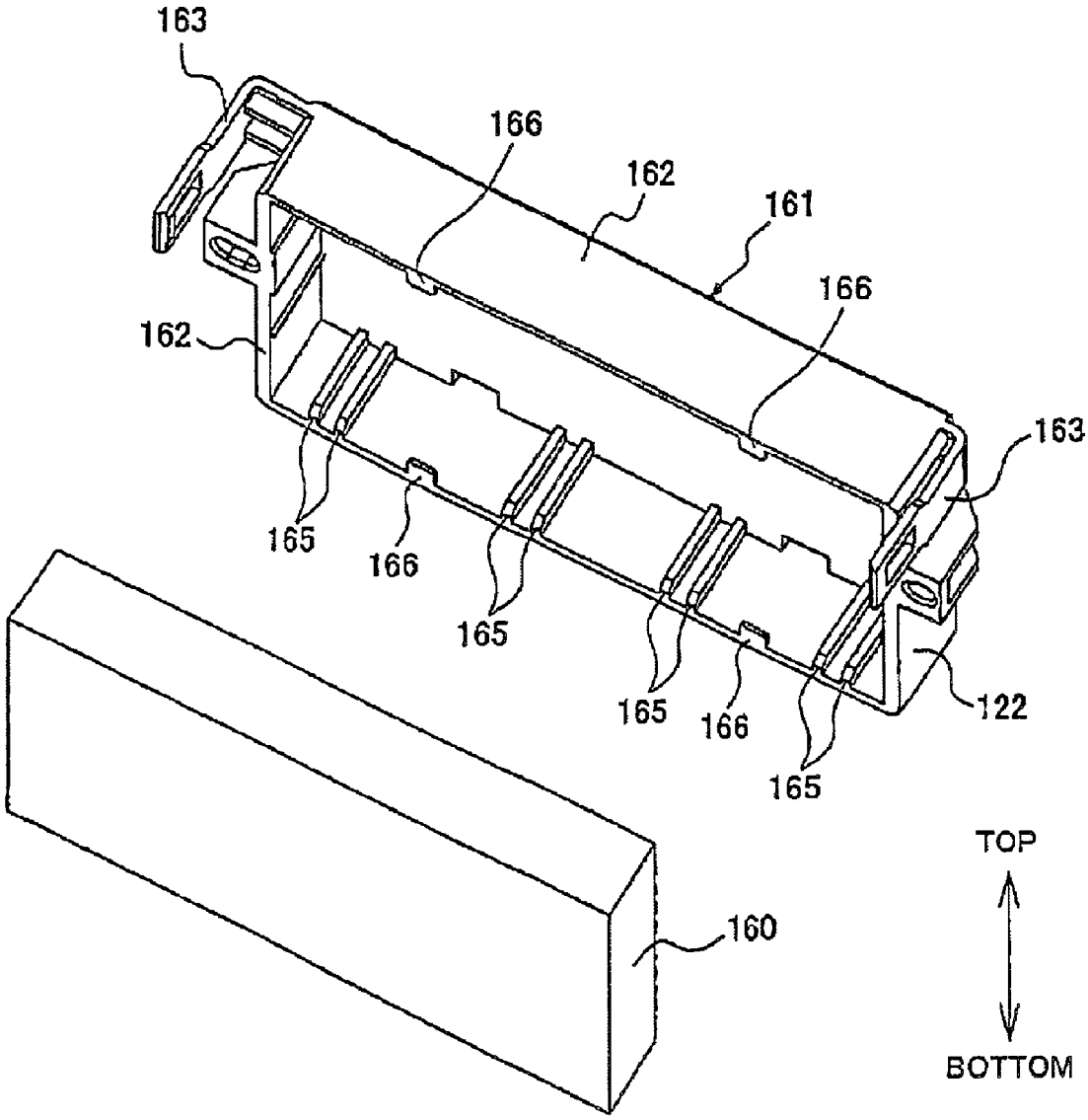
FIG. 25 is an exploded perspective view of the fixing plate shown in FIG. 23.

As shown in FIG. 24 and FIG. 25, elongated projections 165 are formed on an inner bottom surface of the frame body 162 and the ink absorber 160 is pushed to an upper inner wall side of the frame body 162 by the elongated projections 165.

Figure 22:
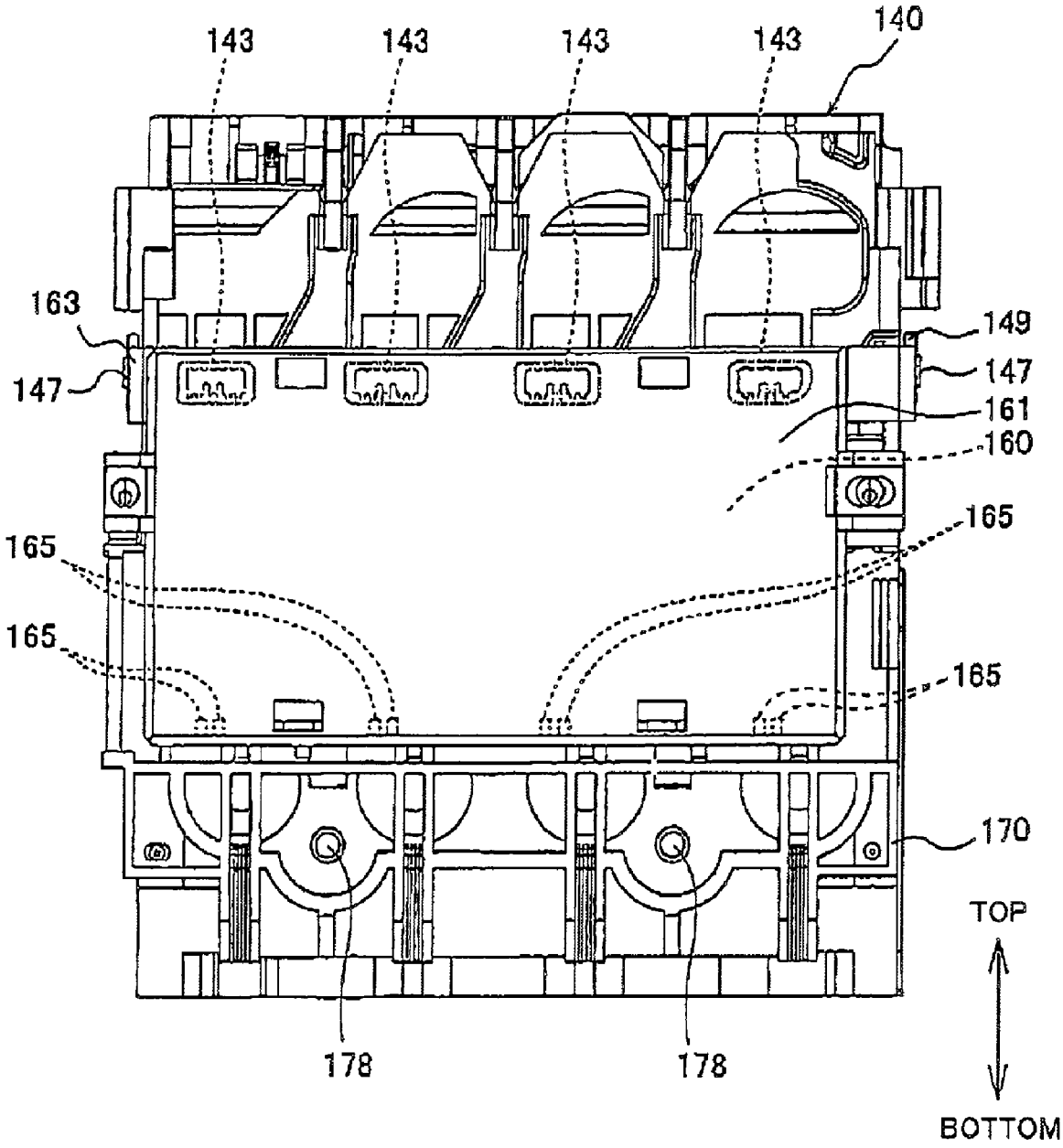
FIG. 22 is a view in which the ink refilling unit is viewed from rear (an image recording part side) in the embodiment of the present invention.

Accordingly, when the ink absorber 160 fitted in the ink absorber casing is assembled to the cartridge casing 142, the elongated projections 165 are located substantially vertically below a position where the distal ends of the atmospheric-pressure introducing sleeves 143 and the ink absorber 160 come into contact with each other, as shown in FIG. 22.

Here, in the embodiment, elongated projections 165 are disposed in pairs.

The fixing plate 161 integrally includes the frame body 162 and the elongated projections 165 a by molding using a resin. As the elongated projections 165 are formed in pairs on the inner bottom surface of the frame body 162, the elongated projections 165 are formed with substantially uniform thickness, and the ink absorber 160 is uniformly pressed into contact with the distal ends of the respective atmospheric-pressure introducing sleeves 143, so that formability (a yield rate above a certain level) is ensured.

Further, in the same manner as the embodiment shown in FIG. 20, the center M of the engaging projecting portion 147 (FIG. 9A) formed on each side wall of the cartridge casing 142 is offset upwardly from the center m of the atmospheric-pressure introducing sleeve 143 as viewed in the horizontal direction and, at the same time, as shown in FIG. 10, the engaging holes 170*a* of the elbow member 170 are positioned below the center m of the atmospheric-pressure introducing sleeves 143.

Accordingly, the fixing plate 161 is fixed to the cartridge casing 142 at positions which sandwich a center position of the atmospheric-pressure introducing sleeve 143 in a direction perpendicular to a projecting direction of the atmospheric-pressure introducing sleeve 143 (in the vertical direction in this embodiment) such that a side of the fixing plate 161 that faces the distal ends of the atmospheric-pressure introducing sleeves 143 is placed within a range from the center M of the engaging projecting portion 147 to the engaging holes 170*a* in the vertical direction with respect to the horizontal level of the center m of the atmospheric-pressure introducing sleeves 143. In other words, the fixing plate 161 covers the atmospheric-pressure introducing sleeves 143 vertically with respect to the center m.

In the multi-functional device 1 according to the embodiment, to further miniaturize a size of the multi-functional device 1 in the front-rear direction, the image recording part 110 is arranged close to the ink filling unit 140 compared to the embodiment and hence, the image recording part 110 is required to scan the vicinity of the cartridge casing 142 (reciprocal movement) (see FIG. 3 and FIG. 4). In such a structure, when the ink absorber 160 (fixing plate 161) having the same size as the ink absorber 160 (fixing plate 161) in the embodiment is used, a drawback that an upper end of the ink absorber 160 interferes with the image recording part 110 occurs.

Such a drawback can be overcome by displacing the fixing plate 161 to a position at which the interference of the fixing plate 161 with the image recording part 110 is not generated. However, in such a structure, a portion where the atmospheric-pressure introducing sleeves 143 and the ink absorber 160 are brought into contact with each other is displaced to an end portion of the ink absorber 160 and hence, the ink absorber 160 may not sufficiently absorb the leaked ink.

Figure 23:
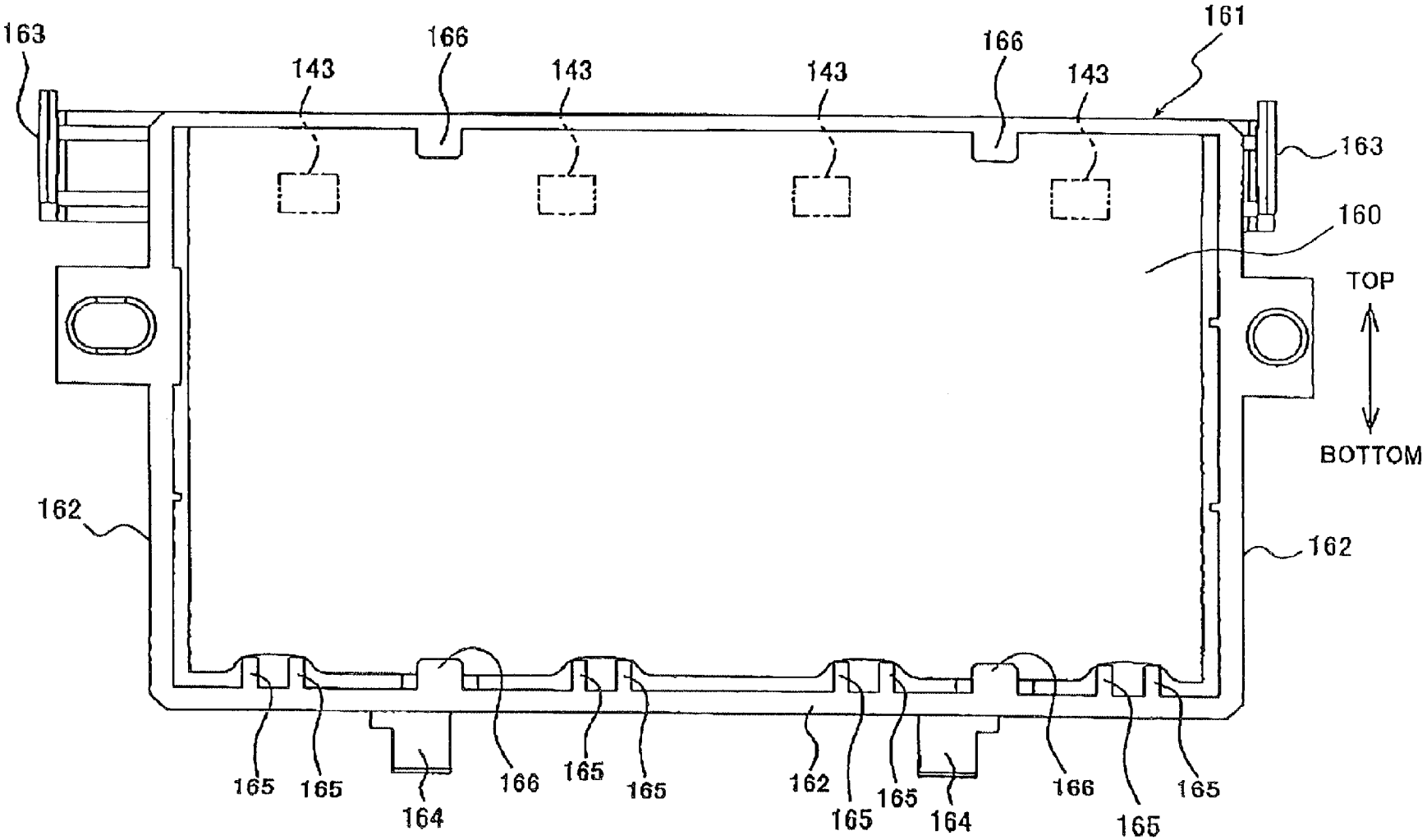
FIG. 23 is a view of a fixing plate in a state that an ink absorber is fitted in the fixing plate in the embodiment of the present invention viewed from the ink absorber side.

On the other hand, as shown in FIG. 23 to FIG. 25, the ink absorber 160 is formed of a porous material such as sponge, urethane, fibers and non-woven fabric as described above and, at the same time, the ink absorber 160 is mounted in the ink absorber casing in a state that outer peripheral edges of the ink absorber 160 are slightly depressed by the frame 162.

In FIG. 23 to FIG. 25, numeral 166 indicates stopper portions that are formed upright on an upper frame portion and a lower frame portion of the frame body 162. The stopper portions 166 are configured to prevent the ink absorber 160 from being removed from the ink absorber casing toward the atmospheric-pressure introducing sleeves 143 which the ink absorber 160 faces.

In fitting the ink absorber 160 in the inside of the frame 162 of the ink absorber casing, when a deformation quantity of the ink absorber 160 is small, a holding strength of the ink absorber casing required for holding the ink absorber 160 in the fixing plate 161 is decreased.

However, the ink absorber 160 absorbs ink by holding and sucking ink in an innumerable number of small pores formed in the inside of the ink absorber 160 and small interstices defined between fibers. Thus, when the ink absorber 160 is fitted into the frame body 162 in a largely deformed state in order to ensure a large holding force, the small pores and the small interstices defined between the fibers for absorbing ink are collapsed or crushed and hence, the ink absorber 160 cannot absorb a sufficient quantity of ink.

That is, to surely bring the ink absorber 160 and the atmospheric-pressure introducing sleeves 143 into contact with each other, when the holding force is increased to prevent the displacement of the ink absorber 160, the small pores and the small interstices defined between the fibers for absorbing the ink are collapsed or crushed and hence, the ink absorber 160 cannot absorb a sufficient quantity of ink.

On the other hand, in an attempt to prevent the crushing of the small pores and the small interstices defined between the fibers for absorbing the ink, the holding force is decreased and hence, the position of the ink absorber 160 is displaced. Accordingly, the ink absorber 160 and the atmospheric-pressure introducing sleeves 143 may be brought out of contact with each other, and thus the ink absorber 160 cannot absorb a sufficient quantity of ink.

To the contrary, according to the embodiment, the elongated projections 165 are formed on the inner bottom surface of the frame body 162 to contact the lower end surface of the ink absorber 160 and hence, the ink absorber 160 is deformed with the elongated projections 165.

Due to the elongated projections 165, the holding force required for holding the ink absorber 160 in the ink absorber casing can be increased.

On the other hand, the elongated projections 165 are partially brought into contact with the ink absorber 160 to deform the ink absorber 160 by crushing. Compared to a case in which the ink absorber 160 is deformed by depressing the whole outer peripheral edges of the ink absorber 160, the deformation of the ink absorber 160 occurs partially and, at the same time, a deformation quantity of the ink absorber 160 is decreased.

In this manner, in the embodiment, the structure of the ink absorber casing prevents the small pores and the small interstices defined between the fibers in the ink absorber 160 from being greatly crushed, while increasing the holding force for holding the ink absorber 160. Accordingly, even when the multi-functional device 1 is further miniaturized, the ink absorber 160 surely absorbs ink leaked from the atmospheric-pressure introducing port 193.

Further, in the embodiment, the elongated projections 165 are arranged substantially vertically below the atmospheric-pressure introducing sleeves 143. Due to the provision of these elongated projections 165, a position where the ink absorber 160 is locally deformed and a position where the atmospheric-pressure introducing sleeves 143 are brought into contact with the ink absorber 160 agree with each other. Accordingly, ink leaked from the atmospheric-pressure introducing port 193 can be surely absorbed by the ink absorber 160.

(Other Technical Features of the Present Invention)

Figure 21:
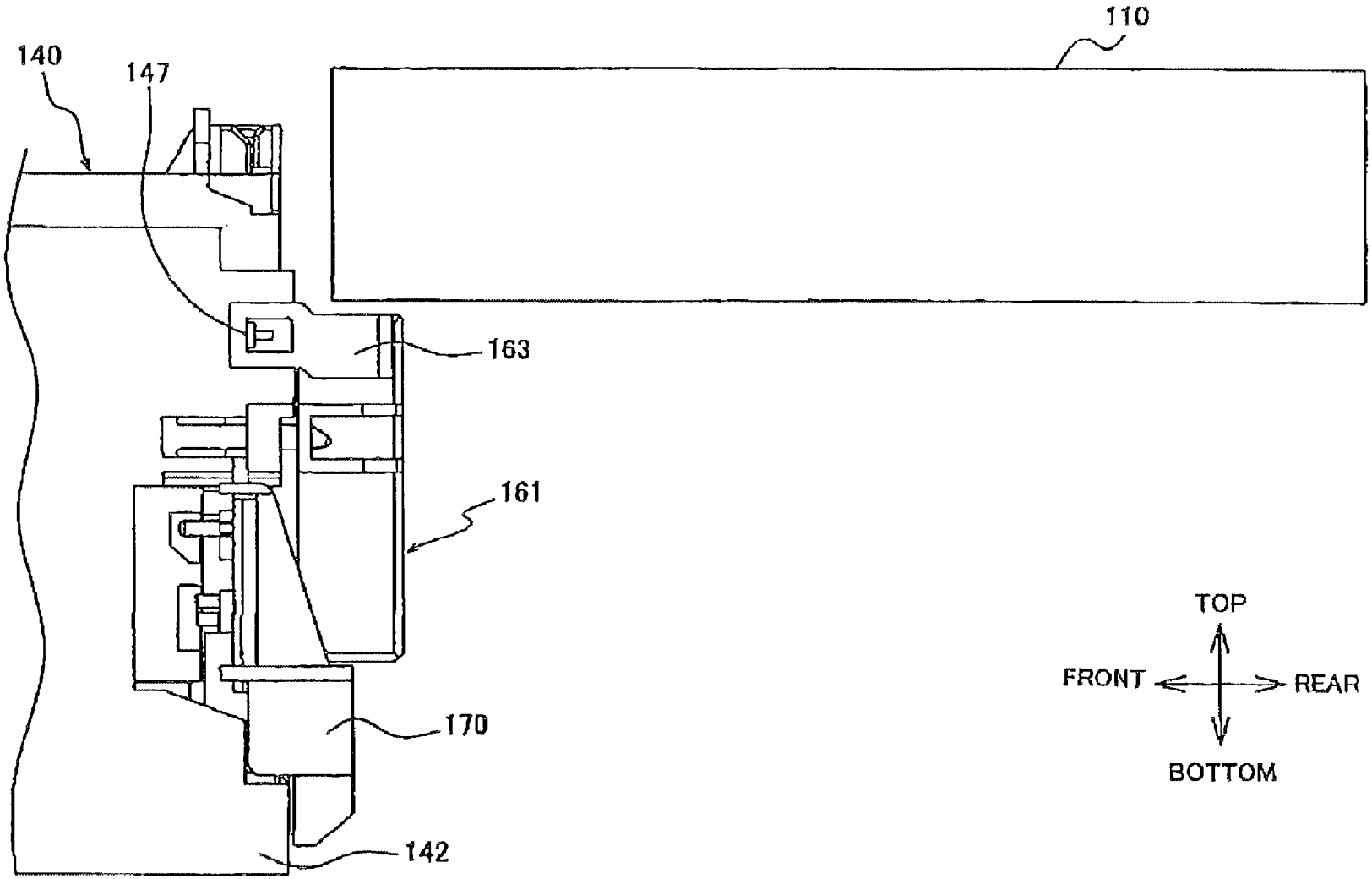
FIG. 21 is a view showing an arrangement relationship between the ink refilling unit and an image recording part in the embodiment of the present invention.

While the waste ink box 118 is arranged close to the ink refilling unit 140 in the embodiment, as shown in FIG. 21, the present invention is applied to a multi-functional device 1 in which the image recording part 110 (carriage) scans the vicinity of the cartridge casing 142 of the ink refilling unit 140.

In the above-mentioned embodiment, the description has been made based on the color-type ink jet recording apparatus including ink cartridges of a plurality of colors as an example. However, the present invention is not limited to such an embodiment and may be applied to a black-and-white ink jet recording apparatus including only black ink cartridge, for example.

Further, in the above-mentioned embodiment, the first guide portions 148 and the second guide portions 149 are formed on the cartridge casing 142 by integral molding. However, the present invention is not limited to such a structure.

Still further, in the above-mentioned embodiment, the ink tubes 141 which are connected to the elbow member 170 (ink refilling unit 140) extend upwardly. However, the present invention is not limited to such a structure.

In the above-mentioned embodiment, the ink refilling unit 140 is disposed such that the liquid level of ink in the inside of the ink cartridge 190 becomes lower than the recording head 111. Thus, a proper meniscus is formed in the ink ejecting port of the recording head 111. However, the present invention is not limited to the structure. For example, a porous material such as sponge may be disposed in the inside of the ink cartridge 190 and a proper meniscus ray be formed in the ink ejecting port by making use of an ink suction force which the porous material possesses.

In the above-mentioned embodiment, the leaked ink leading member 180 is also constituted of the porous material in the same manner as the ink absorber 160. However, the present invention is not limited to such a structure and the leaked ink leading member 180 may be formed of a non-porous body made of a resin.

In the above-mentioned embodiment, the elbow member 170 and the cartridge casing 142 are formed as separate members. However, the present invention is not limited to such a structure and, for example, the elbow member 170 and the cartridge casing 142 may be integrally formed.

In the above-mentioned embodiment, the arcuate wall portions 150 are formed at portions of the cartridge casing 142 which face the corresponding atmospheric-pressure introducing ports 193. However, the present invention is not limited to such a structure and the wall portions 150 may be eliminated or the wall portions 150 may be formed in a rectangular shape (picture-frame shape).

Although the embodiment and modification of the present invention have been described in detail herein, the scope of the invention is not limited thereto. It will be appreciated by those skilled in the art that various modifications may be made without departing from the scope of the invention. Accordingly, the embodiment and modification disclosed herein are only exemplary. It is to be understood that the scope of the invention is not to be limited thereby, but is to be determined by the claims which follow.

What is claimed is:

1. An ink refilling unit comprising:

an ink cartridge configured to store ink, the ink cartridge including a discharge port configured to discharge the ink, and an atmospheric-pressure introducing port configured to introduce atmospheric pressure to an inside of the ink cartridge;

a cartridge casing configured to receive the ink cartridge therein, the cartridge casing including an atmospheric-pressure introducing sleeve having a distal end projecting to the outside from the cartridge casing, the atmospheric-pressure introducing sleeve communicating with the atmospheric-pressure introducing port of the ink cartridge, the atmospheric-pressure introducing sleeve having a slit formed in a bottom surface thereof to allow the inside and the outside of the atmospheric-pressure introducing sleeve to communicate with each other;

an ink absorber comprising a surface which is brought into contact with the distal end of the atmospheric-pressure introducing sleeve and an outer peripheral surface around the surface, the ink absorber configured to absorb ink leaked from the atmospheric-pressure introducing port; and an ink absorber housing including a fixing plate and a frame body formed on a periphery of the fixing plate, the ink absorber housing configured to accommodate the ink absorber therein and fix the ink absorber to the fixing plate, the ink absorber housing including at least one projecting ridge on an inner surface of the frame body, the projecting ridge configured to partially press the outer peripheral surface of the ink absorber accommodated in the ink absorber housing.

2. The ink refilling unit according to claim 1, wherein the projecting ridge is arranged in a position remote from the distal end of the atmospheric-pressure introducing sleeve in a direction perpendicular to a direction in which the atmospheric-pressure introducing sleeve projects.

3. The ink refilling unit according to claim 2, wherein the projecting ridge is arranged in a position substantially vertically below a position where the distal end of the atmospheric-pressure introducing sleeve contacts the ink absorber accommodated in the ink absorber casing.

4. The ink refilling unit according to claim 1, wherein the ink absorber housing has portions thereof fixed to the cartridge casing at positions which sandwich a center position of the atmospheric-pressure introducing sleeve in a direction perpendicular to a projecting direction of the atmospheric-pressure introducing sleeve.

5. The ink refilling unit according to claim 1, wherein the cartridge casing is configured to allow the insertion of the ink cartridge thereinto in the horizontal direction thus allowing the discharge port and the atmospheric-pressure introducing port to open horizontally, and the atmospheric-pressure introducing sleeve is horizontally opened.

6. A leaked ink absorbing method for an ink jet recording apparatus comprising the steps of:

mounting a plurality of ink cartridges each configured to store ink and include an atmospheric pressure introducing port in the inside of a cartridge casing;

connecting the respective atmospheric pressure introducing ports of the plurality of ink cartridges communicably with a plurality of atmospheric pressure introducing sleeves which are formed on the cartridge casing and have distal ends thereof projected to the outside of the cartridge casing;

connecting an ink absorber housing which is constituted of a fixing plate and a frame body formed on a periphery of the fixing plate and accommodates an ink absorber to the cartridge casing, wherein the ink absorber has a surface;

allowing the inside and the outside of the atmospheric-pressure introducing sleeves to communicate with each other through slits formed in bottom surfaces of the atmospheric-pressure introducing sleeves;

bringing the ink absorber into contact with the distal ends of the atmospheric pressure introducing sleeves and an outer peripheral surface around the surface of the ink absorber, thus allowing the ink absorber to absorb ink leaked from the atmospheric pressure introducing port; and fixing the ink absorber firmly to the ink absorber casing by deforming the ink absorber with compression generated using projecting ridges which are formed on an inner surface of the frame body vertically below the atmospheric pressure introducing sleeves thus firmly fixing the ink absorber to the ink absorber casing and promoting the ink leaked from the atmospheric pressure introducing ports.

* * * * *